US006643489B2

(12) United States Patent
Omata et al.

(10) Patent No.: US 6,643,489 B2
(45) Date of Patent: Nov. 4, 2003

(54) IMAGE FORMING APPARATUS AND METHOD

(75) Inventors: Yasukuni Omata, Chigasaki (JP); Hideaki Mochimaru, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/086,412

(22) Filed: Mar. 4, 2002

(65) Prior Publication Data

US 2002/0122679 A1 Sep. 5, 2002

(30) Foreign Application Priority Data

| | | |
|---|---|---|
| Mar. 2, 2001 | (JP) | 2001-057898 |
| Jun. 22, 2001 | (JP) | 2001-189785 |
| Feb. 20, 2002 | (JP) | 2002-043140 |

(51) Int. Cl.[7] ..... G03G 15/00; G03G 15/16

(52) U.S. Cl. ..... 399/309; 399/21; 399/302; 399/308; 399/313

(58) Field of Search ..... 399/302, 303, 399/308, 309, 312, 313, 317, 318, 21, 124

(56) References Cited

U.S. PATENT DOCUMENTS

| | | | | |
|---|---|---|---|---|
| 3,724,944 A | | 4/1973 | Sugita et al. | 355/18 |
| 3,765,760 A | | 10/1973 | Mochimaru | 355/58 |
| 3,884,576 A | | 5/1975 | Mochimaru et al. | 355/69 |
| 3,901,586 A | | 8/1975 | Suzuki et al. | 359/726 |
| 4,056,320 A | | 11/1977 | Mochimaru et al. | 355/75 |
| 4,105,326 A | | 8/1978 | Mochimaru | 355/55 |
| 4,535,982 A | | 8/1985 | Mochimaru | 271/127 |
| 4,605,299 A | | 8/1986 | Mochimaru | 399/111 |
| 4,703,334 A | | 10/1987 | Mochimaru et al. | 347/130 |
| 4,753,543 A | | 6/1988 | Mochimaru et al. | 400/703 |
| 4,757,344 A | | 7/1988 | Idenawa et al. | 399/113 |
| 4,875,063 A | | 10/1989 | Idenawa et al. | 347/152 |
| 4,987,446 A | | 1/1991 | Mochimaru et al. | 399/113 |
| 5,089,855 A | | 2/1992 | Mochimaru et al. | 399/297 |
| 5,159,393 A | * | 10/1992 | Hiroshima et al. | 399/313 |
| 5,276,489 A | * | 1/1994 | Kikuchi et al. | 399/313 X |
| 5,394,231 A | | 2/1995 | Sudo et al. | 399/228 |
| 5,499,078 A | | 3/1996 | Kurokawa et al. | 399/31 |
| 5,559,590 A | | 9/1996 | Arai et al. | 399/314 |
| 5,570,162 A | | 10/1996 | Sohmiya | 399/174 |
| 5,594,540 A | | 1/1997 | Higaya et al. | 399/326 |
| 5,615,872 A | | 4/1997 | Mochimaru | 271/3.14 |
| 5,619,311 A | | 4/1997 | Kurokawa et al. | 399/176 |

(List continued on next page.)

FOREIGN PATENT DOCUMENTS

| | | | |
|---|---|---|---|
| JP | 01-209470 | | 8/1989 |
| JP | 09-274398 | | 10/1997 |
| JP | 2001-183920 | * | 7/2001 |

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes an image bearing member that bears visual images, a visual image forming device that forms the visual images on the image bearing member, and a two-side transfer device including a recording medium holding member spanning a plurality of stretch members to hold a recording medium thereon. The two-side transfer device transfers respective of the visual images on the image bearing member onto respective of both sides of the recording medium on the recording medium holding member while the recording medium holding member is moved in a predetermined direction. The image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

41 Claims, 19 Drawing Sheets

U.S. PATENT DOCUMENTS 5,678,152 A 10/1997 Kohno et al. ..... 399/324
5,732,314 A * 3/1998 Tsukida et al. ..... 399/302
5,758,204 A * 5/1998 Haneda et al. ..... 399/309 X
5,778,291 A * 7/1998 Okubo et al. ..... 399/302
5,797,077 A * 8/1998 Samizo et al. ..... 399/309
5,826,143 A * 10/1998 Haneda et al. ..... 399/309 X
5,832,354 A 11/1998 Kouno et al. ..... 399/330
5,905,931 A * 5/1999 Shigeta et al. ..... 399/309
5,915,147 A 6/1999 Kouno et al. ..... 399/69
6,151,057 A 11/2000 Yamazaki et al. ..... 347/248
6,167,229 A * 12/2000 Watanabe et al. ..... 399/313
6,173,148 B1 1/2001 Matsuda et al. ..... 399/310
6,347,214 B1 2/2002 Kaneko ..... 399/397

* cited by examiner

IMAGE FORMING APPARATUS AND METHOD

BACKGROUND OF THE INVENTION

1. Field of the Invention

The present invention relates to an image forming apparatus such as a copying machine, a printer, a facsimile machine, etc. and a method of forming an image on a recording medium.

2. Discussion of the Background

Image forming apparatuses that form images on both sides of a recording medium such as a transfer sheet by a so-called switchback method are known.

In the switchback method, a visual image such as a toner image that has been formed on an image bearing member is transferred onto one side of a recording medium by a transfer device and is then fixed onto the one side of the recording medium by a fixing device. The recording medium is then reversed by a reversing path, etc., and is conveyed again to the transfer device and the fixing device so that another visual image that has been formed on the image bearing member is transferred and fixed onto the other side of the recording medium.

In the above image forming apparatuses using the switchback method, because a switchback mechanism for reversing a recording medium to be conveyed again to the transfer device and the fixing device is necessary, the cost of the image forming apparatus may be increased. Further, it may be difficult to perform a high speed image formation on both sides of a recording medium due to the switchback process. Moreover, a sheet jam may tend to occur at a time of the switchback process because a recording medium may tend to be curled when an image is fixed onto one side of the recording medium by heat.

FIG. 20 illustrates a schematic view of a background image forming apparatus in which visual images, which have been transferred onto both sides of a recording medium from a first image bearing member and a second image bearing member, are fixed at the same time. Specifically, the image forming apparatus transfers a first visual image formed on a photoreceptor 301 serving as a first image bearing member onto a transfer belt 302 serving as a second image bearing member by a first transfer device 303 and then transfers a second visual image formed on the photoreceptor 301 onto one side of a transfer sheet 304 by the first transfer device 303. Thereafter, the image forming apparatus transfers the first visual image on the transfer belt 302 onto the other side of the transfer sheet 304 by a second transfer device 305, thus transferring the visual images onto both sides of the transfer sheet 304. The transfer sheet 304 is then conveyed to a fixing device 306, where the visual images are fixed onto both sides of the transfer sheet 304 at the same time.

In the background image forming apparatus of FIG. 20, because the above-described switchback mechanism and process are not necessary, an increase of the cost of the apparatus and occurrence of sheet jam in a switchback process may be prevented. Further, a high speed image formation on both sides of a recording medium may be performed.

However, in the background image forming apparatus of FIG. 20, a transfer nip part formed between the photoreceptor 301 and the transfer belt 302 is relatively small. In other words, the photoreceptor 301 contacts the transfer belt 302 in a point contact state. In such a point contact state, stable transferring of an image may be difficult to achieve. Unstable transferring of an image may result in an inferior transfer of an image, and may result in image blurring.

SUMMARY OF THE INVENTION

According to one aspect of the present invention, an image forming apparatus includes an image bearing member configured to bear visual images, a visual image forming device configured to form the visual images on the image bearing member, and a two-side transfer device including a recording medium holding member spanning a plurality of stretch members to hold a recording medium thereon. The two-side transfer device is configured to transfer respective of the visual images on the image bearing member onto respective of both sides of the recording medium on the recording medium holding member while the recording medium holding member is moved in a predetermined direction. The image forming apparatus further includes a fixing device configured to fix the visual images transferred onto the both sides of the recording medium. The image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
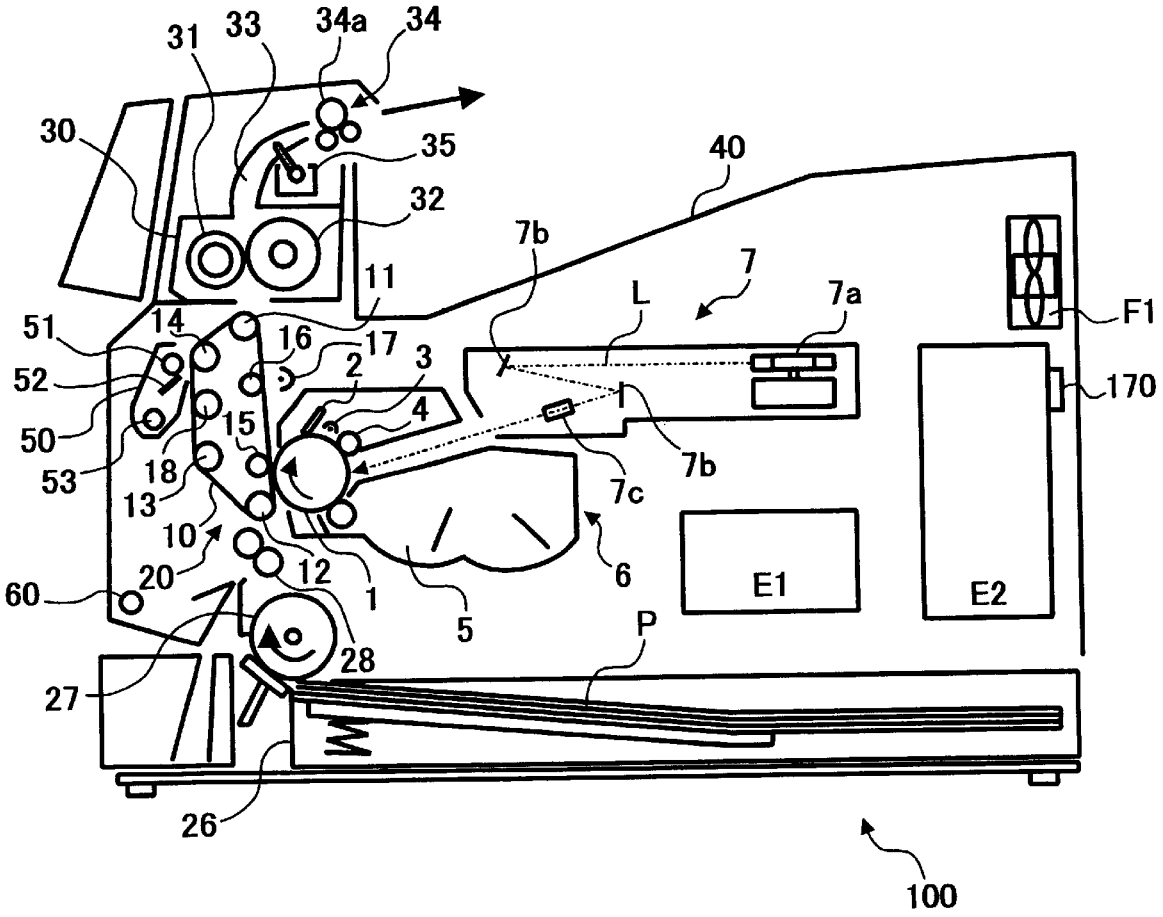
FIG. 1 is a schematic cross-sectional view of a printer as an example of an image forming apparatus according to an embodiment of the present invention.

Preferred embodiments of the present invention are described in detail referring to the drawings, wherein like reference numerals designate identical or corresponding parts throughout the several views.

FIG. 1 is a schematic cross-sectional view of an example of an image forming apparatus to which the present invention can be applied. In this embodiment, the image forming apparatus of FIG. 1 is an electrophotographic printer (hereinafter simply referred to as a printer), although the present invention is applicable to other image forming apparatuses.

Referring to FIG. 1, a printer 100 includes a drum-shaped photoreceptor serving as an image bearing member at a substantially central part of the printer 100 in a vertical direction. Arranged around the photoreceptor 1 are a cleaning device 2, a discharging device 3, a charging device 4, and a developing device 5. In this embodiment, the photoreceptor 1, the cleaning device 2, the discharging device 3, the charging device 4, and the developing device 5 are integrally assembled in a process cartridge 6. The process cartridge 6 is replaced with a new one when its useful lifetime ends.

The charging device 4 is driven to rotate in a clockwise direction in FIG. 1 by a drive device (not shown) to uniformly charge the surface of the photoreceptor 1 with a negative polarity. The uniformly charged surface of the photoreceptor 1 is exposed to laser light emitted from an exposure device 7 (details of which are described later), and thereby an electrostatic latent image is formed on the surface of the photoreceptor 1.

The developing device 5 develops the electrostatic latent image on the photoreceptor 1 with toner accommodated in the developing device 5 to form a toner image. The toner image on the photoreceptor 1 is transferred onto a sheet conveying belt 10 or a transfer sheet P by a two-side transfer device 20. The details of the two-side transfer device 20 are described later.

The cleaning device 2 removes unnecessary toner remaining on the surface of the photoreceptor 1 after the toner image is transferred from the photoreceptor 1 onto the sheet conveying belt 10 or a transfer sheet P. After the cleaning device 2 removes residual toner from the photoreceptor 1, the surface of the photoreceptor 1 is uniformly discharged by the discharging device 3 to be prepared for a next image forming operation.

The exposure device 7 is arranged at a right side of the process cartridge 6 in FIG. 1. A laser light "L" emitted by the exposure device 7 irradiates the photoreceptor 1 at a writing position between the charging device 4 and the developing device 5.

Further, a sheet feeding device is arranged below the process cartridge 6 in FIG. 1. The sheet feeding device includes a sheet feeding cassette 26, a sheet feeding roller 27, and a pair of registration rollers 28. The sheet feeding cassette 26 accommodates a plurality of transfer sheets P as recording media. The sheet feeding roller 27 contacts an uppermost transfer sheet P. When the sheet feeding roller 27 is driven to rotate in a clockwise direction in FIG. 1 by a drive device (not shown), the uppermost transfer sheet P is fed out to a nip part between the registration rollers 28. The transfer sheet P is further fed out by the registration rollers 28 toward a transfer position (described later) at an appropriate timing.

Moreover, the two-side transfer device 20 is arranged at a left side of the process cartridge 6 in FIG. 1. The two-side transfer device 20 includes the endless sheet conveying belt 10 serving as a recording medium holding member, stretch rollers 11, 12, 13, and 14, a transfer roller 15, a rear-side supporting roller 16, a transfer charger 17 serving as a charge applying device, and a cooling device 18. The two-side transfer device 20 is configured such that the sheet conveying belt 10 contacts a part of the photoreceptor 1.

The sheet conveying belt 10 spans the stretch rollers 11, 12, 13, and 14. One of the stretch rollers 11, 12, 13, and 14 serves as a drive roller to drive the sheet conveying belt 10 to rotate in a counterclockwise direction in FIG. 1. The one of the stretch rollers 11, 12, 13, and 14 serving as a drive roller is constructed such that a wrapping angle of the sheet conveying belt 10 is secured to some degree to surely transmit its drive force to the sheet conveying belt 10.

The transfer roller 15 is arranged such that the sheet conveying belt 10 is sandwiched between the photoreceptor 1 and the transfer roller 15. The transfer roller 15 generates a transfer electric field between the transfer roller 15 and the photoreceptor 1 with voltage of a positive polarity applied to the transfer roller 15 from a power supply (not shown). A toner image on the photoreceptor 1 is transferred onto the sheet conveying belt 10 or a transfer sheet P fed out from the registration rollers 28, by the influence of the transfer electric field.

With the movements of the sheet conveying belt 10, the transfer sheet P having the toner image transferred from the photoreceptor 1 thereonto is conveyed toward a heat fixing device 30 arranged above the two-side transfer device 20 in FIG. 1, after passing through a position where the sheet conveying belt 10 opposes the transfer charger 17. The functions of the transfer charger 17 and the cooling device 18 are described later.

The heat fixing device 30 includes a heat roller 31 having a heater (not shown) inside thereof and a pressure roller 32. The transfer sheet P fed from the sheet conveying belt to the heat fixing device 30 is sandwiched between the heat roller 31 and the pressure roller 32. After the toner image on the transfer sheet P is fixed by heat of the heat roller 31 and pressure between the heat roller 31 and the pressure roller 32, the transfer sheet P having a fixed toner image is conveyed to a sheet discharging path 33. Subsequently, the transfer sheet P in the sheet discharging path 33 is discharged onto an upper surface of a main body of the printer 100 via a sheet discharging device 34 including a sheet discharging roller 34*a*.

A sheet discharging and stacking part 40 is formed at the upper surface of the main body of the printer 100. The transfer sheet P discharged from the sheet discharging device 34 is stacked on the sheet discharging and stacking part 40 in order.

An electric unit E1 and a control unit E2 are arranged between the sheet feeding cassette 26 and the exposure device 7 to perform an electronic control of respective devices in the printer 100. Further, a fan F1 is arranged at a right upper corner of the main body of the printer 100 in FIG. 1 for discharging internal air forcibly to prevent the inside temperature from rising excessively.

The printer 100 according to the FIG. 1 embodiment of the present invention is configured to form not only an image on one side of a transfer sheet P, but to form images on both sides of a transfer sheet P by the following image forming process.

In the description of obtaining images on both sides of a transfer sheet P, an image that is first formed is referred to as a first side image, and an image that is later formed is referred to as a second side image. Further, a sheet side onto which the first side image is transferred is referred to as a first sheet side, and a sheet side onto which the second side image is transferred is referred to as a second sheet side.

Figure 2:
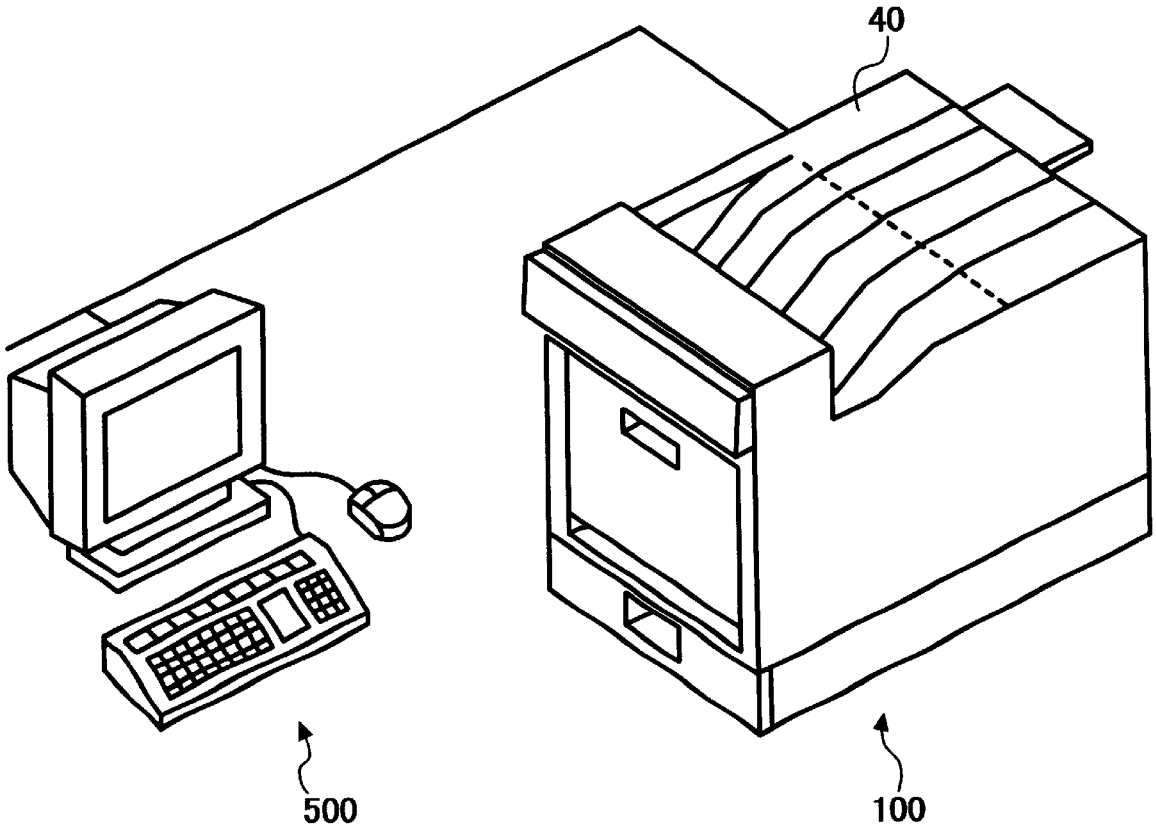
FIG. 2 is a perspective view of a host computer and the printer of FIG. 1.

As illustrated in FIG. 2, the printer 100 is configured to form images in accordance with a signal for writing an image sent from a host computer 500 through an interface 170 of the printer 100. Again with reference to FIG. 1, the exposure device 7 is driven according to an image signal that has been received. A laser light "L" emitted from a laser light source (not shown) of the exposure device 7 is deflected so as to scan by a polygonal mirror 7*a* that is rotated by being driven by a motor (not shown). The laser light "L" is irradiated onto the photoreceptor 1 that has been uniformly charged by the charging device 4 via mirrors 7*b*, and a fθ lens 7*c*, etc., so that an electrostatic latent image corresponding to writing information is formed on the photoreceptor 1.

The latent image on the photoreceptor 1 is developed with toner by the developing device 5, and thereby a visual image (i.e., a toner image) is formed and carried on the surface of the photoreceptor 1 as a first side image. A first side toner image on the photoreceptor 1 is conveyed to a transfer position where the photoreceptor 1 and the sheet conveying belt 10 contact each other, by rotation of the photoreceptor 1.

At this time, a transfer sheet P is not fed to the transfer position. The first side toner image on the photoreceptor 1 is not transferred onto a transfer sheet P but onto the sheet conveying belt 10, which is being moved in synchronization with the rotation of the photoreceptor 1. Subsequently, the sheet conveying belt 10 carrying the first side toner image moves one cycle and returns to the transfer position.

While the sheet conveying belt 10 moves one cycle, subsequent exposure and developing processes start to form a second side toner image on the photoreceptor 1, and sheet feeding starts. A transfer sheet P is fed out from the sheet feeding cassette 26 to the registration rollers 28. Further, the registration rollers 28 feed out the transfer sheet P at an appropriate timing such that the first sheet side (a lower side in FIG. 1, i.e., a sheet surface opposing the sheet conveying belt 10) of the transfer sheet P and the first side toner image on the sheet conveying belt 10 that returns to the transfer position are correctly aligned.

On the other hand, the second side toner image is formed on the photoreceptor 1 at an appropriate timing such that the second sheet side (an upper side in FIG. 1, i.e., a sheet surface opposing the photoreceptor 1) of the transfer sheet P and the second side toner image on the photoreceptor 1 are correctly aligned. Therefore, the transfer sheet P is sandwiched between the first side toner image on the sheet conveying belt 10 and the second side toner image on the photoreceptor 1 at the transfer position.

In this condition, the second side toner image on the photoreceptor 1 is transferred onto the second sheet side of the transfer sheet P by the influence of the transfer electric field generated by the transfer roller 15. At this time, even though the first side toner image contacts the first sheet side of the transfer sheet P, the first side toner image is not yet transferred onto the first sheet side of the transfer sheet P from the sheet conveying belt 10, because the first side toner image positioned between the sheet conveying belt 10 and the first sheet side of the transfer sheet P is attracted to the sheet conveying belt 10 by an electrostatic force generated by the transfer electric field.

After passing the transfer position, the transfer sheet P moves together with the sheet conveying belt 10 in a condition that the transfer sheet P carries the second side toner image transferred onto the second sheet side thereof at the transfer position, and the first sheet side of the transfer sheet P contacts the first side toner image on the sheet conveying belt 10. When the transfer sheet P passes a position where the transfer sheet P opposes the transfer charger 17, the first side toner image is electrostatically transferred onto the first sheet side of the transfer sheet P from the sheet conveying belt 10. At this time, because a predetermined gap is formed between the second sheet side of the transfer sheet P and the transfer charger 17, the second side toner image on the second sheet side of the transfer sheet P is prevented from being transferred to the transfer charger 17.

As described above, the two-side transfer device 20 allows the first and second side toner images to be transferred onto the first and second sheet sides of the transfer sheet P, respectively, by the actions of the transfer roller 15 and the transfer charger 17. Thus, the two-side transfer device 20 functions as a device that transfers toner images onto both sides of a transfer sheet P.

When the first side toner image on the sheet conveying belt 10 passes a charge applying position of the transfer charger 17 not together with the transfer sheet P and the second side toner image, the transfer charger 17 is controlled to be in a non-operated state.

When a mirror image is formed on the photoreceptor 1 and the image is directly transferred onto a transfer sheet P, the image is obtained as a correct image on the transfer sheet P. When an image formed on the photoreceptor 1 is first transferred onto the sheet conveying belt 10 and is then transferred onto a transfer sheet P, if the image is formed on the photoreceptor 1 as a mirror image, the image is obtained on the transfer sheet P as the mirror image. Therefore, in the embodiment, the first side toner image, which is transferred from the sheet conveying belt 10 to a transfer sheet P, is formed on the photoreceptor 1 as a correct image, and the second side toner image, which is directly transferred from the photoreceptor 1 onto the transfer sheet P, is formed as a mirror image on the photoreceptor 1.

The transfer charger 17 may be arranged upstream of the transfer position instead of downstream of the transfer position in the moving direction of the sheet conveying belt 10. For example, if the polarity of the first side toner image carried on the sheet conveying belt 10 is reversed by an action of the transfer charger 17 provided at a position where the transfer charger 17 opposes the sheet conveying belt 10 between the stretch rollers 12 and 13, the first side toner image on the sheet conveying belt 10, which is positively charged, is transferred onto the transfer sheet P by electrostatic repulsion of the first toner image against the transfer roller 15 to which a positive transfer bias is applied, and the second side toner image is transferred from the photoreceptor 1 to the transfer sheet P by electrostatic absorption of the negatively charged second side toner image to the transfer sheet P at the transfer position.

Next, an image forming process of the printer 100 when obtaining an image on one side of a transfer sheet P is described. First, a toner image is formed on the photoreceptor 1 as a mirror image and is moved to a transfer position. A transfer sheet P is fed out from the sheet feeding cassette 26 to the registration rollers 28. Further, the registration rollers 28 feed out the transfer sheet P to the transfer position at an appropriate timing such that the toner image on the photoreceptor 1 and the transfer sheet P are correctly aligned. Thereafter, the toner image is transferred onto the transfer sheet P (an upper side in FIG. 1, i.e., a sheet surface opposing the photoreceptor 1) at the transfer position. The transfer sheet P having the toner image is conveyed to the heat fixing device 30 without charge application by the transfer charger 17. After the toner image is fixed onto the transfer sheet P by the heat fixing device 30, the transfer sheet P having a fixed toner image is discharged to the sheet discharging and stacking part 40.

The printer 100 employs a contact transfer method in which a toner image on the photoreceptor 1 is transferred toward the sheet conveying belt 10 at the transfer position where the sheet conveying belt 10 is brought into contact with the photoreceptor 1. As compared to a non-contact transfer method in which a transfer member (e.g., a sheet conveying belt) is separated from an image bearing member (e.g., a photoreceptor) and a toner image flies toward the transfer member from the image bearing member, the toner image on the photoreceptor 1 is transferred toward the sheet conveying belt 10 without flying toward the sheet conveying belt 10 in the contact transfer method. Therefore, a displacement of transferred toner image due to a deviation of a toner image from a flying path may be avoided in the contact transfer method.

In the printer 100 employing the contact transfer method, if a part of the sheet conveying belt 10 heated by influence of the heat fixing device 30 is brought into contact with the photoreceptor 1 before cooling sufficiently, heat damage may be caused to the photoreceptor 1. Therefore, as illustrated in FIG. 1, the cooling device 18 is provided at a rear surface side of the sheet conveying belt 10 to cool a part of the sheet conveying belt 10 that is heated by the heat fixing device 30 when the sheet conveying belt 10 passes close to the heat fixing device 30. The cooling device 18 may employ an air blasting cooling system, a cooling system using a cooling acceleration member, etc. In any cooling systems, the cooling device 18 preferably cools the sheet conveying belt 10 from the rear surface side of the sheet conveying belt 10 without disturbing the first side toner image carried on the sheet conveying belt 10.

As described above, the first side toner image, which is transferred onto the sheet conveying belt 10 from the photoreceptor 1 at the transfer position, is further transferred onto the first sheet side of the transfer sheet P when the first side toner image on the sheet conveying belt 10 passes the position where the sheet conveying belt 10 opposes the transfer charger 17 together with the transfer sheet P. When the transfer sheet P is separated from the sheet conveying belt 10, a part of toner, residual toner, of the first side toner image remains on the sheet conveying belt 10. If such residual toner on the sheet conveying belt 10 contacts a succeeding transfer sheet P fed to the transfer position by the registration rollers 28, the residual toner may stain the first sheet side of the transfer sheet P.

Therefore, the printer 100 includes a belt cleaning unit 50 at a downstream position of the stretch roller 11 in the moving direction of the sheet conveying belt 10 to remove residual toner from the sheet conveying belt 10. As seen from FIG. 1, the transfer sheet P is separated from the sheet conveying belt 10 in the vicinity of the stretch roller 11. The belt cleaning unit 50 includes a cleaning roller 51, a blade 52, a toner conveying screw 53, and a contacting/separating mechanism (not shown).

The cleaning roller 51 is configured to rotate with the sheet conveying belt 10 while sandwiching the sheet conveying belt 10 between the cleaning roller 51 and the stretch roller 14 that contacts the rear surface of the sheet conveying belt 10. The residual toner on the front surface of the sheet conveying belt 10 contacts the rotating cleaning roller 51 and then moves from the sheet conveying belt 10 to the cleaning roller 51. The toner on the cleaning roller 51 is scraped off by the blade 52 and drops on the toner conveying screw 53 arranged below the blade 52. The toner conveying screw 53 rotates and conveys the toner in the axial direction of the toner conveying screw 53 to a toner collecting device (not shown).

In the belt cleaning unit 50 thus constructed, the cleaning roller 51 employed may preferably have a surface roughness (JIS-A) of about 3.5 $\mu$m or greater. Because a surface roughness (JIS-A) of the sheet conveying belt 10 may be preferably set to about 3.5 $\mu$m or less, the residual toner on the sheet conveying belt 10 is facilitated to move from the sheet conveying belt 10 to the cleaning roller 51 by use of the cleaning roller 51 having a greater surface roughness than that of the sheet conveying belt 10. Specifically, in this embodiment, the printer 100 can employ a sheet conveying belt 10 having a surface roughness (JIS-A) of about 3.4 $\mu$m, and a cleaning roller 51 having a surface roughness (JIS-A) of about 5.0 $\mu$m, which is a metallic roller made of nickel plated mild steel or stainless.

In the case that the residual toner on the sheet conveying belt 10 is heated to a glass transition temperature or greater by influence of the heat fixing device 30, the belt cleaning unit 50 is preferably arranged at a position where the cleaning roller 51 removes the residual toner before the residual toner is cooled to a glass transition temperature or less by natural heat radiation and before the residual toner is cooled by the cooling device 18. By arranging the belt cleaning unit 50 at the above-described position, the cleaning roller 51 may adequately remove the residual toner from the sheet conveying belt 10 before the residual toner fused by the influence of the heat fixing device 30 is fixed to the sheet conveying belt 10. As a result, a cleaning failure due to the fixing of the residual toner to the sheet conveying belt 10 may be prevented.

Further, a contacting/separating mechanism (not shown) is provided to the belt cleaning unit 50 to allow the cleaning roller 51 to contact and separate from the sheet conveying belt 10. The contacting/separating mechanism is configured to swing the belt cleaning unit 50 around the toner conveying screw 53, for example, by an ON/OFF operation of a solenoid (not shown). By swinging the belt cleaning unit 50, the cleaning roller 51 contacts and separates from the sheet conveying belt 10.

With the provision of the above-described contacting/separating mechanism, when the first side toner image, not the residual toner, is moved to a cleaning position, the first side toner image on the sheet conveying belt 10 may be prevented from being removed from the sheet conveying belt 10 by separating the cleaning roller 51 from the sheet conveying belt 10.

Further, by bringing the cleaning roller 51 into contact with the sheet conveying belt 10 only when the cleaning is necessary, and by separating the cleaning roller 51 from the sheet conveying belt 10 when the cleaning is unnecessary, loads on a rotation drive device of the cleaning roller 51 and on the sheet conveying belt 10 may be reduced. As a result, cleaning performance may be properly maintained.

Figure 3:
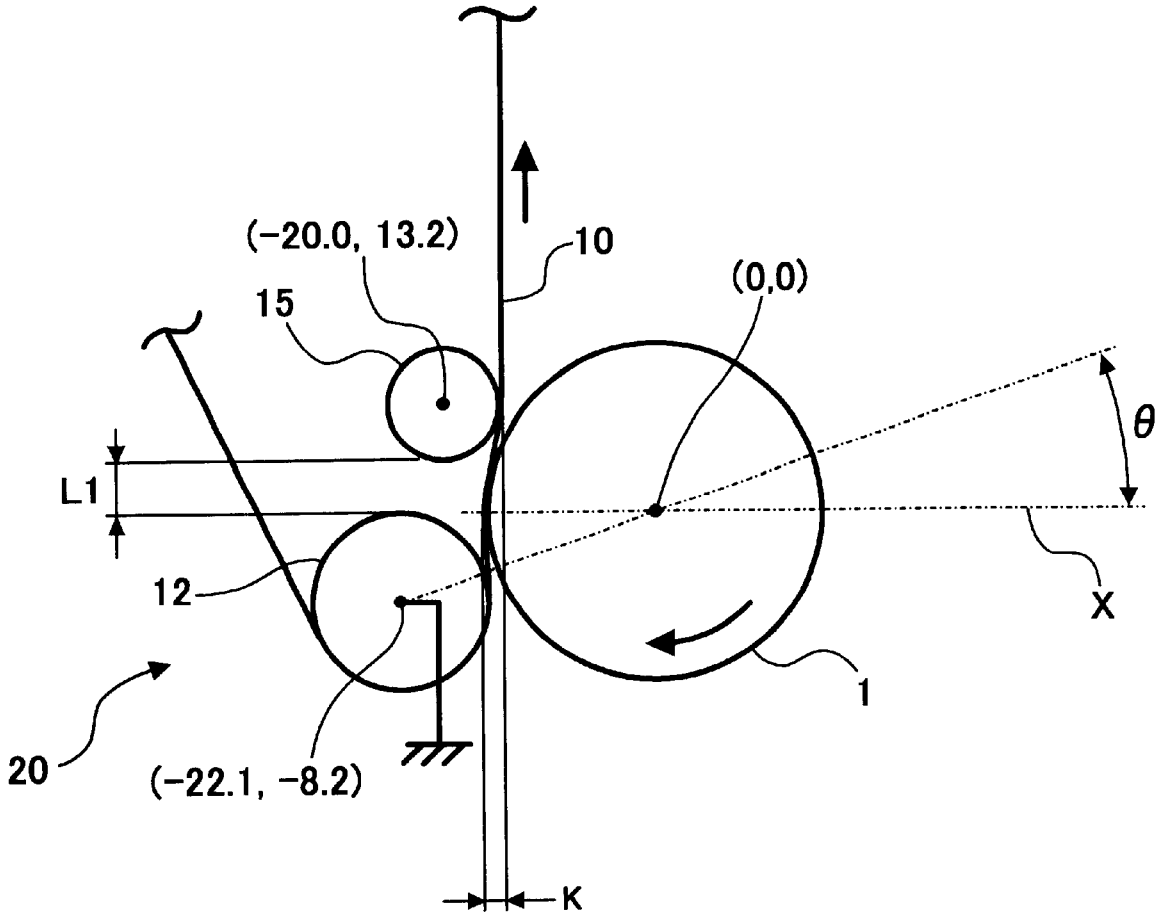
FIG. 3 is an enlarged view of a construction of a part of a two-side transfer device and a photoreceptor of the printer of FIG. 1.

Next, description is made with respect to a feature of the construction of the printer 100. FIG. 3 is an enlarged view of a construction of a part of the two-side transfer device 20 and the photoreceptor 1. Referring to FIG. 3 as an example structure, the stretch roller 12 has a diameter of about 16 mm, the transfer roller 15 has a diameter of about 10 mm, and the photoreceptor 1 has a diameter of about 30 mm.

When the coordinates of the central axis of the photoreceptor 1 is (0, 0), the stretch roller 12 having the diameter of about 16 mm is arranged in parallel with the photoreceptor 1 such that the central axis of the stretch roller 12 is positioned at the coordinates (−22.1, −8.2). Further, the transfer roller 15 having the diameter of about 10 mm is arranged in parallel with the photoreceptor 1 such that the central axis of the transfer roller 15 is positioned at the coordinates (−20.0, 13.2).

The line connecting the central axis of the photoreceptor 1 and the central axis of the stretch roller 12 and a horizontal line X form an angle θ of 20° therebetween. The arrangement position of the two-side transfer device 20 relative to the photoreceptor 1 is set such that the photoreceptor 1 intrudes into a part of the sheet conveying belt 10 spanning the stretch roller 12 and the transfer roller 15 by an intrusion amount K of about 0.54 mm.

In the above-described two-side transfer device 20 thus constructed, the part of the sheet conveying belt 10 spanning the stretch roller 12 and the transfer roller 15 is positively biased against the photoreceptor 1 by the stretch roller 12 and the transfer roller 15. Thereby, the above-described part of the sheet conveying belt 10 is adequately wrapped around a part of the outer circumference of the photoreceptor 1. In this embodiment, the sheet conveying belt 10 is wrapped around about one-tenth of the peripheral length of the photoreceptor 1, thereby forming a transfer nip part having a width of about 8.7 mm. In the case of forming such a transfer nip part, as compared to a point contact of the photoreceptor 1 and the sheet conveying belt 10 at the transfer position, the photoreceptor 1 and the sheet conveying belt 10 securely contact each other at the transfer position, so that occurrence of blurring of a toner image transferred from the photoreceptor 1 onto the sheet conveying belt 10 or a transfer sheet P due to unstable contact condition of the photoreceptor 1 and the sheet conveying belt 10 at the transfer position may be restrained.

Figure 18:
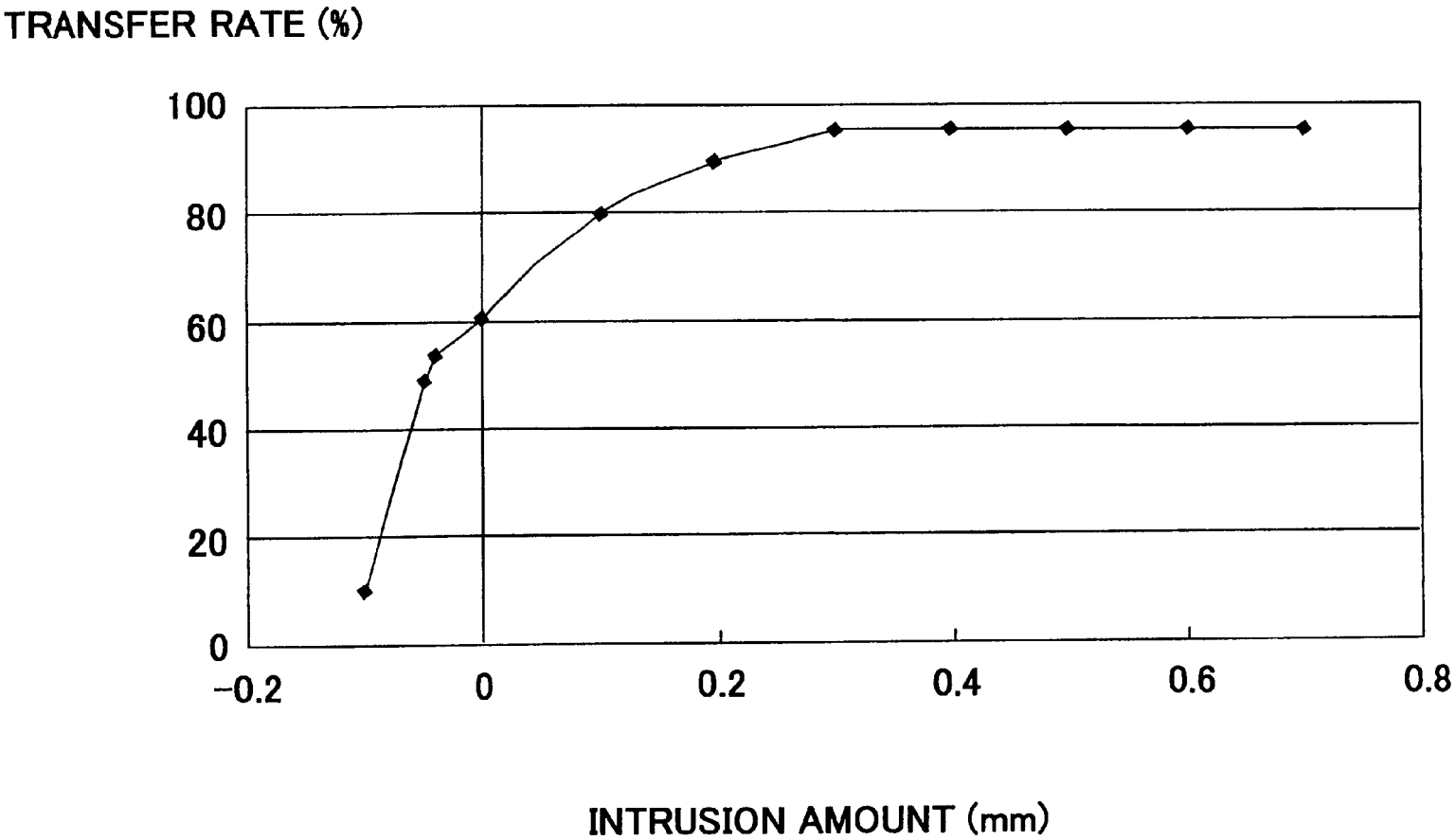
FIG. 18 is a graph illustrating a relationship between a transfer rate of a toner image and an intrusion amount of the photoreceptor or the intermediate transfer belt into the sheet conveying belt.

FIG. 18 is a graph illustrating a relationship between a transfer rate (%) of a toner image and an intrusion amount (mm) of the photoreceptor 1 into the sheet conveying belt 10. As seen from FIG. 18, when the intrusion amount of the photoreceptor 1 into the sheet conveying belt 10 is less than 0.2 mm, the transfer rate of 90% or greater is not obtained. That results because when the intrusion amount of the photoreceptor 1 into the sheet conveying belt 10 is less than 0.2 mm, the contact of the photoreceptor 1 and the sheet conveying belt 10 is not sufficient, resulting in an inferior transfer of a toner image. In the printer 100 according to the embodiment of the present invention, because the intrusion amount K is set to 0.2 mm or greater (i.e., about 0.54 mm), the transfer rate of 90% or greater can be obtained.

If a transfer nip part is formed by contacting the photoreceptor 1 and the sheet conveying belt 10 each other too tightly, a transfer sheet P tends to be curled when the transfer sheet P passes through the transfer nip part. Such a tendency to curl is increased in a thick paper such as a 180K sheet (i.e., a sheet having a weight of about 204 g/m$^2$). When the transfer sheet P is curled at the transfer nip part, a sheet jam tends to occur, and an inferior transfer of a toner image tends to occur when the first side toner image on the sheet conveying belt 10 is transferred onto the first sheet side of the transfer sheet P by the action of the transfer charger 17, due to an insufficient contact of the first side toner image and the transfer sheet P.

In order to prevent occurrences of an inferior transfer of a toner image and a sheet jam caused by a sheet curl, the inventors performed experiments to find a relationship between the intrusion amount K (mm) of the photoreceptor 1 into the sheet conveying belt 10 and a length (mm) of an area of a transfer sheet P from the leading edge of the transfer sheet P where the transfer sheet P is lifted from the surface of the sheet conveying belt 10 due to a sheet curl (hereinafter simply referred to as a lifting amount of the transfer sheet P).

Figure 19:
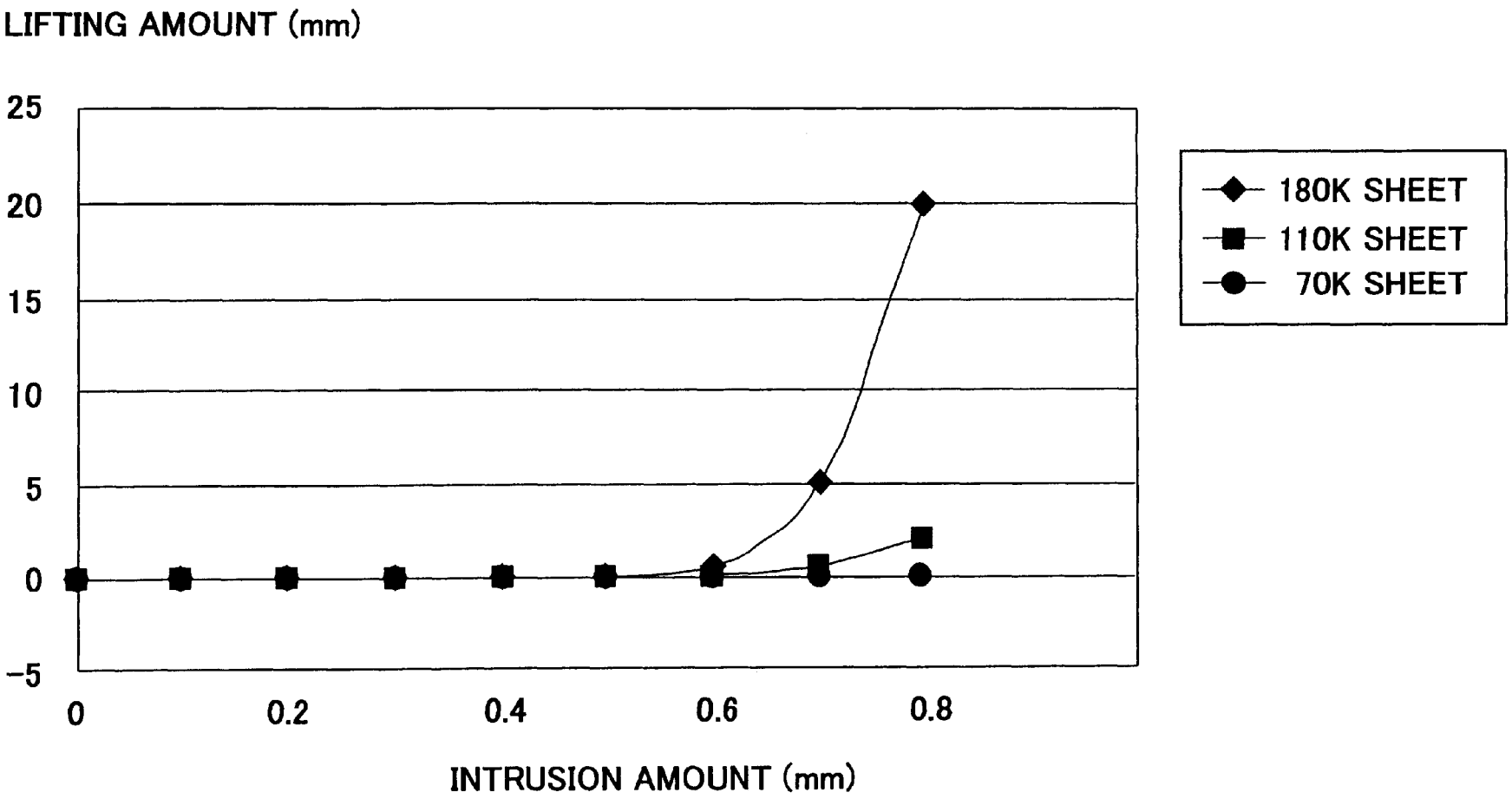
FIG. 19 is a graph illustrating a relationship between a lifting amount of a transfer sheet and an intrusion amount of the photoreceptor or the intermediate transfer belt into the sheet conveying belt.
Figure 20:
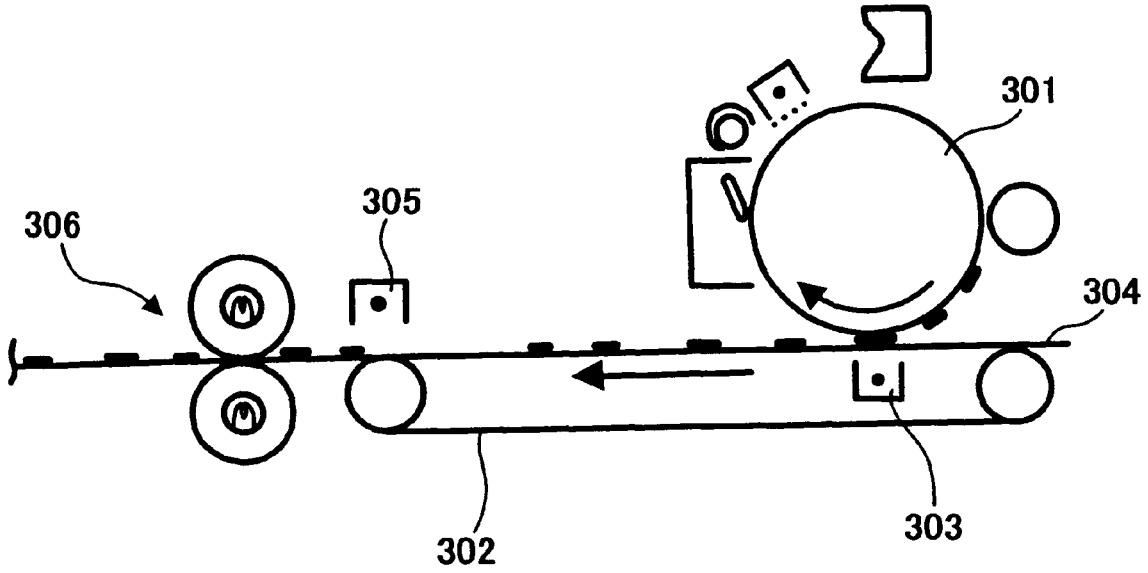
FIG. 20 BACKGROUND ART
FIG. 20 is a schematic view of an image forming apparatus according to a background art.

As illustrated in FIG. 19, it was discovered that the lifting amount of the 180K sheet sharply increases after the intrusion amount of the photoreceptor 1 into the sheet conveying belt 10 exceeds 0.6 mm. Therefore, the intrusion amount K is set to 0.6 mm or less (i.e., about 0.54 mm) in the printer 100, and thereby the above-described inferior transfer of a toner image and sheet jam is typically avoided. Referring to FIG. 19, a 110K sheet is a sheet having a weight of about 125 g/m$^2$, and a 70K sheet is a sheet having a weight of about 79.5 g/m$^2$.

The following was also found by the inventors through intense study. When the stretch roller 12 and the transfer roller 15 adjacent each other are flexed by the tension of the sheet conveying belt 10 by a flexibility amount of greater than 0.1 mm, meanders of the sheet conveying belt 10 tend to occur at the transfer nip part. Therefore, with respect to the stretch roller 12 and the transfer roller 15, which serve to form the transfer nip part, respective materials, cross-section constructions, lengths, and diameters of the stretch roller 12 and the transfer roller 15 are preferably set such that respective flexibility amounts of the stretch roller 12 and the transfer roller 15 by the tension of the sheet conveying belt 10 are suppressed to 0.1 mm or less.

Specifically, each flexibility amount "y" (mm) of the stretch roller 12 and the transfer roller 15 is obtained by the following calculation:

$$y=-(5WL^4)/(384EI),$$

where "W" (kg/mm) is weight per unit length, "L" (mm) is a length of a part of each roller where weight is applied by the sheet conveying belt 10, "E" (kg/mm$^2$) is Young's modulus, and "I" (mm$^4$) is geometrical moment of inertia.

The length "L" of the part of each roller where weight is applied by the sheet conveying belt 10 and the geometrical moment of inertia "I" are preferably set such that the flexibility amount "y" of each roller is suppressed to 0.1 mm or less. Further, a material of each roller is preferably selected such that the Young's modulus "E" and the weight per unit length "W" allow the flexibility amount "y" of each roller to be 0.1 mm or less.

By suppressing the flexibility amount "y" of the stretch roller 12 and the transfer roller 15 to 0.1 mm or less, meanders of the sheet conveying belt 10 at the transfer nip part may be prevented.

The geometrical moment of inertia "I" is obtained by the following calculation:

$$I=\pi(D1^4-D2^4)/64,$$

where D1 is an outer diameter of a roller and D2 is an inner diameter of a roller.

In this embodiment, the printer 100 can employ a transfer roller 15 that is a conductive solid (not hollow) roller made of stainless and has a diameter of about 10 mm. By use of such a transfer roller 15, the flexibility amount "y" of the transfer roller 15 is suppressed to 0.1 mm or less. In addition, because the transfer roller 15 is a metallic roller of high durability, the transfer roller 15 may perform a stable electrostatic transferring of an image for a longer time than a roller made of conductive rubber, for example. Further, the printer 100 can employ a stretch roller 12 that is a solid (not hollow) roller made of stainless and has a diameter of about 16 mm. By use of such a stretch roller 12, the flexibility amount "y" of the stretch roller 12 is suppressed to 0.1 mm or less.

Further, the charging of the stretch roller 12 due to friction between the sheet conveying belt 10 and the stretch roller 12 is obviated by grounding the stretch roller 12. In this embodiment, a transfer bias of 7 kV or less can be applied to the transfer roller 15. In this condition, an electric discharge between the transfer roller 15 and the stretch roller 12 is obviated by separating the transfer roller 15 from the stretch roller 12 by a distance L1 in FIG. 3 of about 5 mm or more. Particularly, the distance L1 can be set to about 7 mm in this embodiment.

Figure 4:
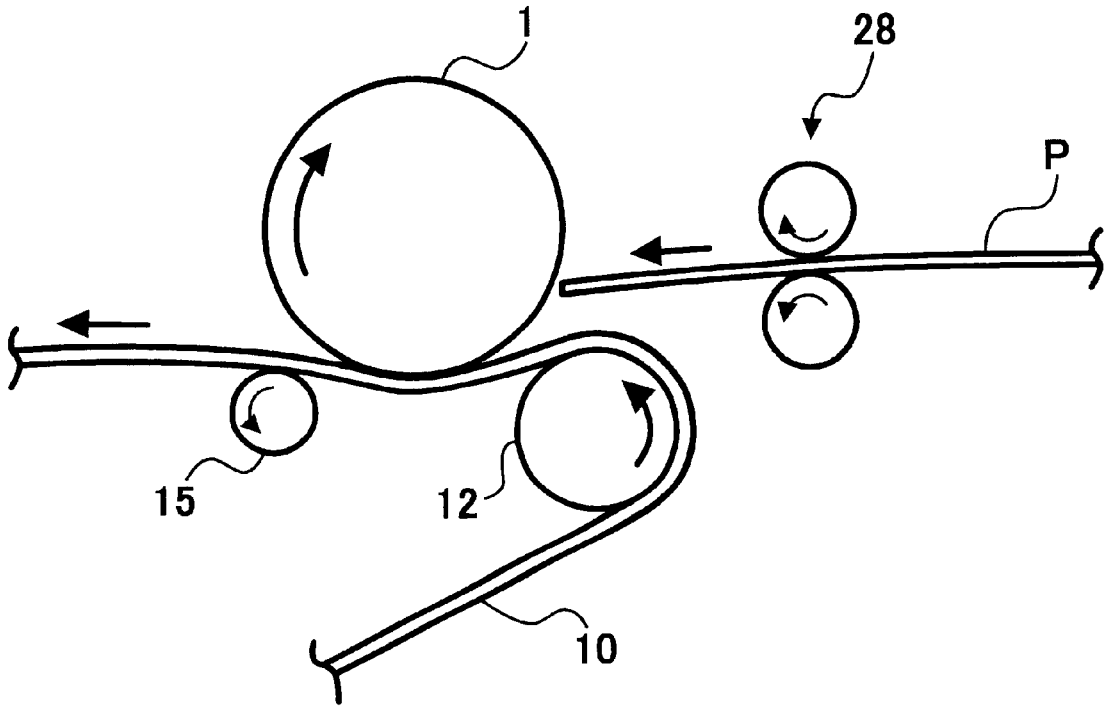
FIG. 4 is a schematic view of a pair of registration rollers and a transfer nip part between the photoreceptor and a sheet conveying belt in the printer of FIG. 1.

FIG. 4 is a schematic view of the registration rollers 28 and the transfer nip part between the photoreceptor 1 and the sheet conveying belt 10. As illustrated in FIG. 4, the registration rollers 28 are arranged at a position such that a leading edge of a transfer sheet P fed from the sheet feeding cassette 26 contacts the photoreceptor 1 before contacting the sheet conveying belt 10. In such an arrangement of the registration rollers 28, as compared to a case in which a leading edge of a transfer sheet P fed from the sheet feeding cassette 26 contacts the sheet conveying belt 10 before contacting the photoreceptor 1, a toner image may be properly transferred from the photoreceptor 1 to the transfer sheet P.

Figure 5:
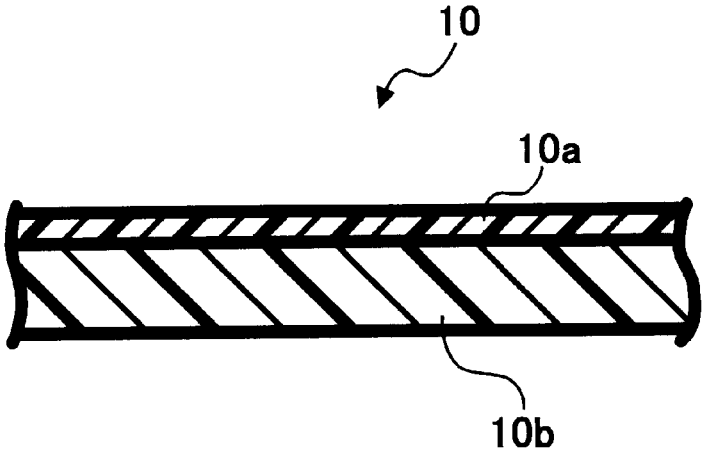
FIG. 5 is a cross-sectional view of a part of the sheet conveying belt of the two-side transfer device.

FIG. 5 is a cross-sectional view of a part of the sheet conveying belt 10. As illustrated in FIG. 5, the sheet conveying belt 10 has a two-layer construction. Specifically, the sheet conveying belt 10 includes a bottom layer **10*b* made of polyimide or polyamide, is and a surface layer 10*a* made of fluoroplastic. By coating the bottom layer 10*b* with the surface layer 10*a* made of fluoroplastic having a low adhesive property, the surface layer 10*a* serves as a toner releasing layer. With provision of the surface layer 10*a* on the bottom layer 10*b*, toner is likely to be released from the sheet conveying belt 10 when a transfer sheet P having the first side toner image is separated from the sheet conveying belt 10 and when the cleaning roller 51 removes residual toner from the sheet conveying belt 10**.

As an example of the fluoroplastic for the surface layer **10*a*, so-called Teflon (trademark) such as polytetrafluoroethylene (PTFE) may be employed. Further, ethylene-tetrafluoroethylene copolymers (ETFE), tetrafluoroethylene-hexafluoropropylene copolymers (FEP), tetrafluoroethylene-perfluoroalkyl vinyl ether copolymers (PFA), chlorotrifluoroethylene resins (CTFE), and chlorotrifluoroethylene-ethylene resins (ECTFE) may be also employed. In this embodiment, the bottom layer 10*b* made of polyimide can be coated with the surface layer 10*a*** made of polytetrafluoroethylene (PTFE).

Figure 6A:
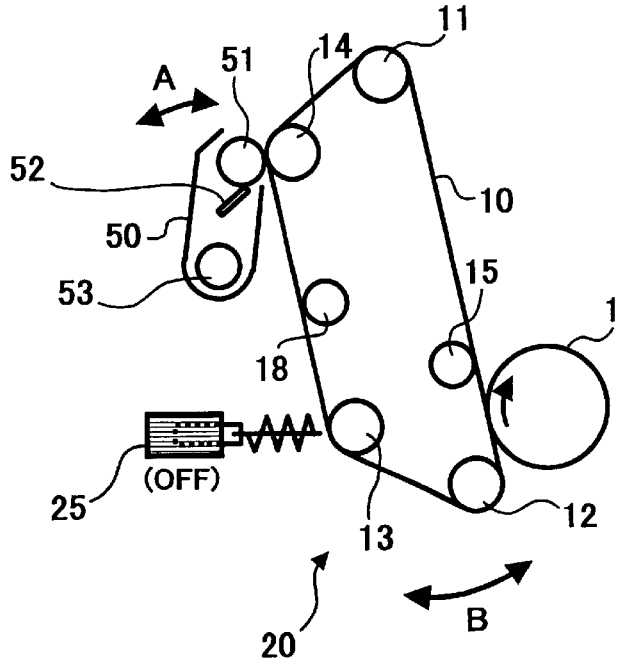
FIGS. 6A and 6B are schematic views for explaining a contacting/separating mechanism in the two-side transfer device according to the embodiment of the present invention.
Figure 6B:
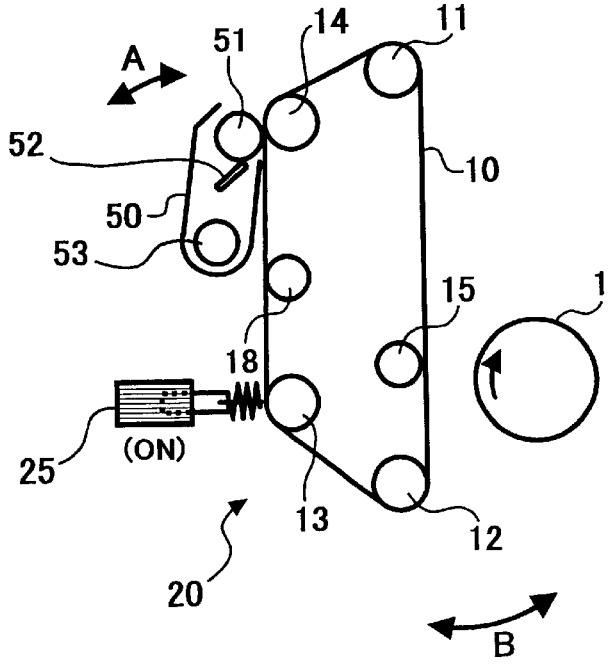

As shown in FIGS. 6A and 6B, the above-described two-side transfer device 20 includes a solenoid 25 serving as a contacting/separating device that contacts and separates the two-side transfer device 20 with and from the photoreceptor 1. The stretch roller 11 of the two-side transfer device 20 is a drive roller that drives the sheet conveying belt 10 to rotate. As illustrated in FIGS. 6A and 6B, the two-side transfer device 20 swings around the stretch roller 11 in a direction indicated by a double-headed arrow B by an ON/OFF operation of the solenoid 25.

As described above, the belt cleaning unit 50 arranged at a position where the sheet conveying belt 10 is sandwiched between the belt cleaning unit 50 and the stretch roller 14 of the two-side transfer device 20 is configured to swing around the toner conveying screw 53 in a direction indicated by a double-headed arrow A in FIGS. 6A and 6B.

When the two-side transfer device 20 is swung leftward in FIG. 6B around the stretch roller 11 by turning on the solenoid 25, the belt cleaning unit 50 is biased by the stretch roller 14, and thereby the belt cleaning unit 50 is inclined leftward in FIG. 6B around the toner conveying screw 53. As illustrated in FIG. 6B, when the two-side transfer device 20 and the belt cleaning unit 50 are swung and inclined as described above, the sheet conveying belt 10 is separated from the photoreceptor 1. As a result, the transfer nip part does not exist between the photoreceptor 1 and the sheet conveying belt 10 as illustrated in FIG. 6B.

On the other hand, by turning off the solenoid 25, the two-side transfer device 20 is swung rightward in FIG. 6A around the stretch roller 11. At substantially the same time, the belt cleaning unit 50 is swung rightward in FIG. 6A around the toner conveying screw 53. Thereby, the sheet conveying belt 10 contacts the photoreceptor 1 as illustrated in FIG. 6A.

As described above, in the printer 100 according to the FIG. 1 embodiment of the present invention, the sheet conveying belt 10 is configured to be separated from the photoreceptor 1 by the contacting/separating device if necessary. Therefore, loads on the sheet conveying belt 10 and the photoreceptor 1 may be reduced, and the transfer performance of the two-side transfer device 20 may be properly maintained. Further, a foreign substance clogged in the transfer nip part may be easily removed therefrom.

It is preferable that the sheet conveying belt 10 be brought into contact with the photoreceptor 1 during at least a period of time in which the first side toner image and the second side toner image on the photoreceptor 1 pass a position where the first side toner image and the second side toner image oppose the sheet conveying belt 10 by rotation of the photoreceptor 1. By contacting the sheet conveying belt 10 and the photoreceptor 1 in the above-described period of time, the first side toner image and the second side toner image on the photoreceptor 1 may surely enter the transfer nip part.

It is more preferable that a contact condition of the sheet conveying belt 10 and the photoreceptor 1 be maintained during a period of time in which exposure and developing processes are performed on the photoreceptor 1 in addition to the above-described period of time. Thereby, toner images are not disturbed by vibrations caused by contacting and separating the sheet conveying belt 10 from the photoreceptor 1 in processes of exposure and developing. As a result, image blurring is prevented.

It is still more preferable that a sheet jam detecting device be provided to detect an occurrence of sheet jam in a sheet conveying path from the sheet feeding cassette 26 to the sheet discharging and stacking part 40. When the sheet jam detecting device detects an occurrence of sheet jam, the sheet conveying belt 10 is separated from the photoreceptor 1.

As an example of the sheet jam detecting device, as illustrated in FIG. 1, a sheet detecting sensor 35 such as a photosensor may be provided in the vicinity of the sheet discharging device 34. When the sheet detecting sensor 35 does not detect a transfer sheet P after a predetermined time has elapsed from when the sheet feeding roller 27 feeds out the transfer sheet P, it is judged that a sheet jam occurs in a sheet conveying path. Even if a transfer sheet P is jammed in the transfer nip part, the transfer sheet P may be easily removed from the sheet conveying path by separating the sheet conveying belt 10 from the photoreceptor 1 based on a detection output of the sheet jam detecting device.

As described above, the transfer nip part is formed between the sheet conveying belt 10 and the photoreceptor 1 by use of the transfer roller 15 and the stretch roller 12. However, the transfer roller 15 is not necessarily used for the transfer nip part.

Figure 7:
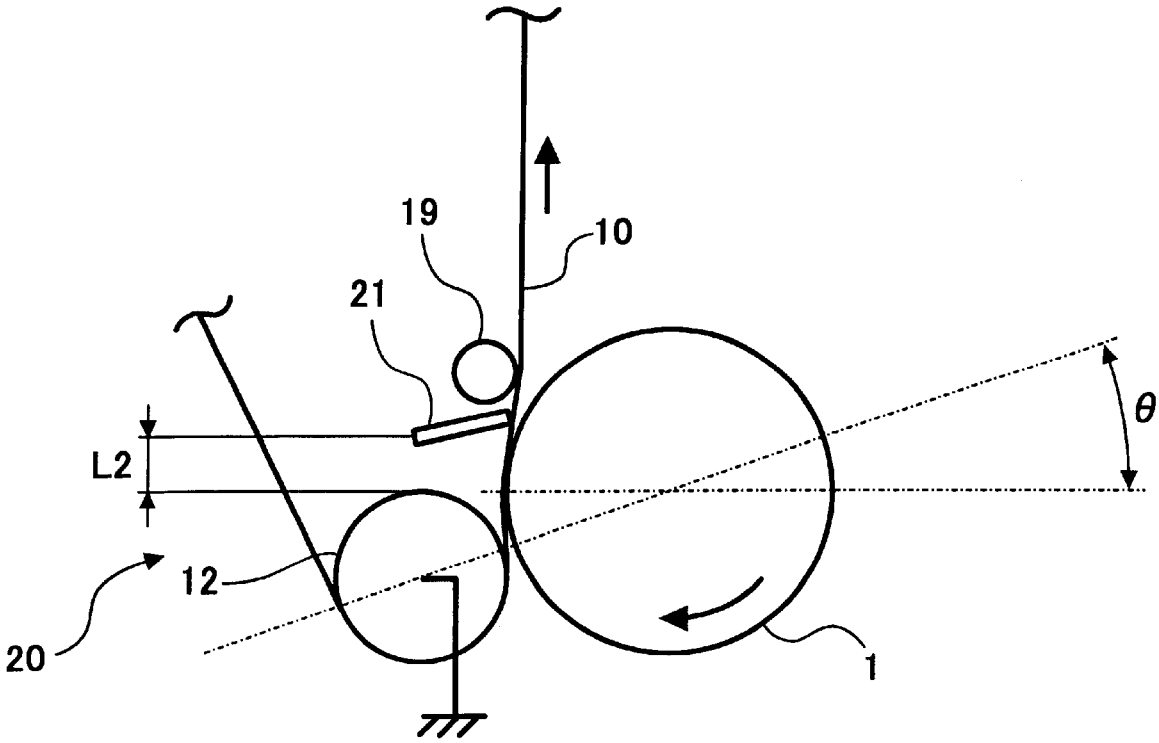
FIG. 7 is a schematic view of a part of the two-side transfer device and the photoreceptor according to of a alternative example.

FIG. 7 is a schematic view of a part of the two-side transfer device 20 and the photoreceptor 1 according to an alternative example. In this alternative example, a transfer nip part is formed by arranging the photoreceptor 1 and the two-side transfer device 20 such that the photoreceptor 1 intrudes into a part of the sheet conveying belt 10 spanning the stretch roller 19 and the stretch roller 12 as illustrated in FIG. 7. Further, a conductive brush 21 is arranged in the two-side transfer device 20 such that the conductive brush 21 contacts a rear surface of the sheet conveying belt 10 between the stretch rollers 19 and 12. A transfer bias is applied to the sheet conveying belt 10 by the conductive brush 21. The conductive brush 21 contacts the sheet conveying belt 10 at a position downstream of the center of the photoreceptor 1 in the moving direction of a transfer sheet P by a distance "L2". In this alternative example, the distance "L2" is set to about 8 mm. The conductive brush 21 contains foreign substances sandwiched between the sheet conveying belt 10 and the conductive brush 21 in its flexible brushes, thereby decreasing damage to the sheet conveying belt 10 due to foreign substances sandwiched between the sheet conveying belt 10 and the conductive brush 21.

Figure 8:
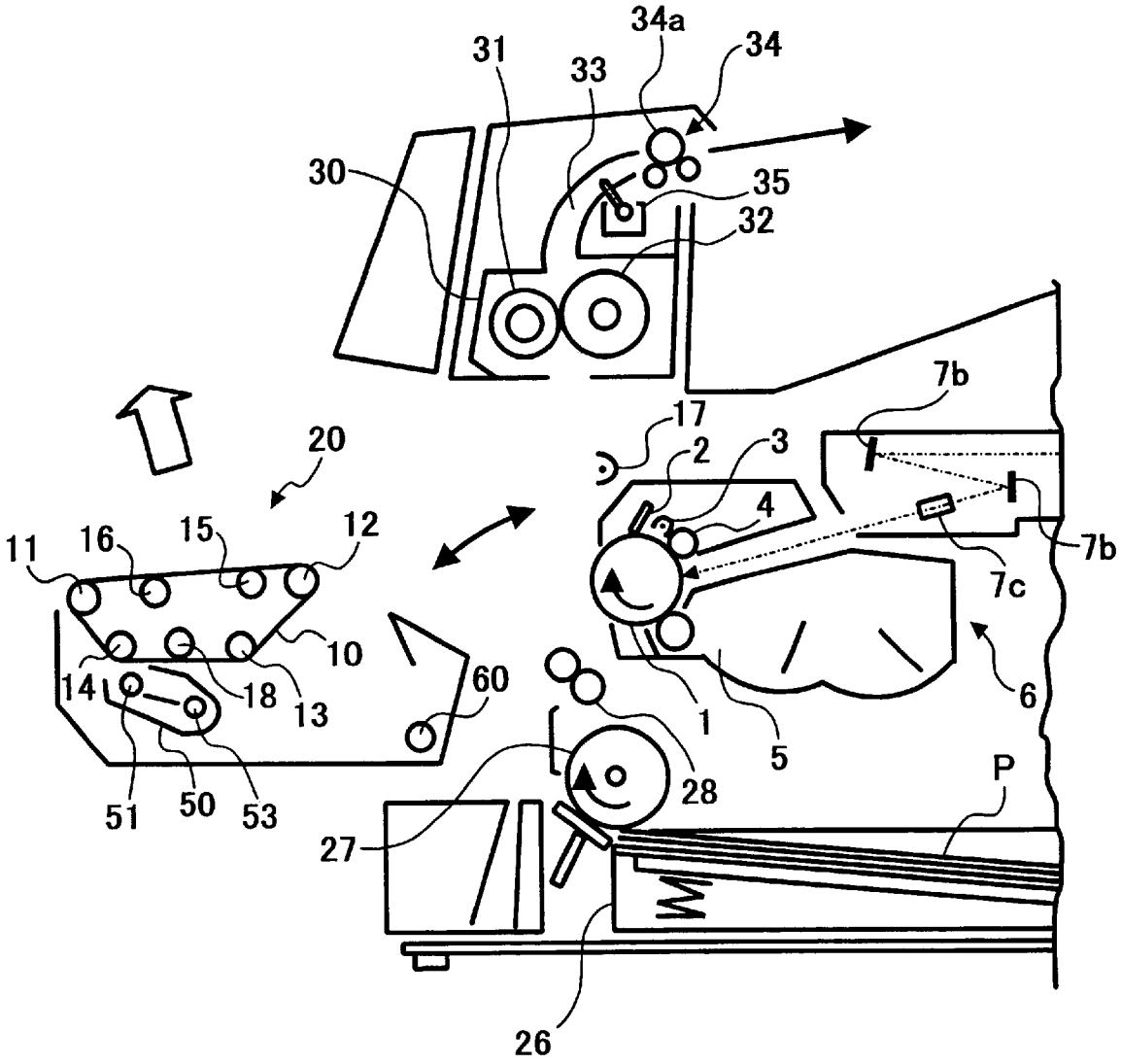
FIG. 8 is a schematic cross-sectional view of the printer of FIG. 1 when a frame of a main body of the printer is opened.

In the FIG. 1 embodiment, beside the process cartridge 6, the two-side transfer device 20 is configured to be replaced with a new one when its useful lifetime ends. As illustrated in FIG. 8, a frame of the main body of the printer 100 is opened around an open/close support axis 60 so that replacement work for the two-side transfer device 20 and clearing work for a jammed sheet are facilitated.

Next, a printer as an image forming apparatus to which the present invention is applied according to another embodiment of the present invention is described.

Figure 9:
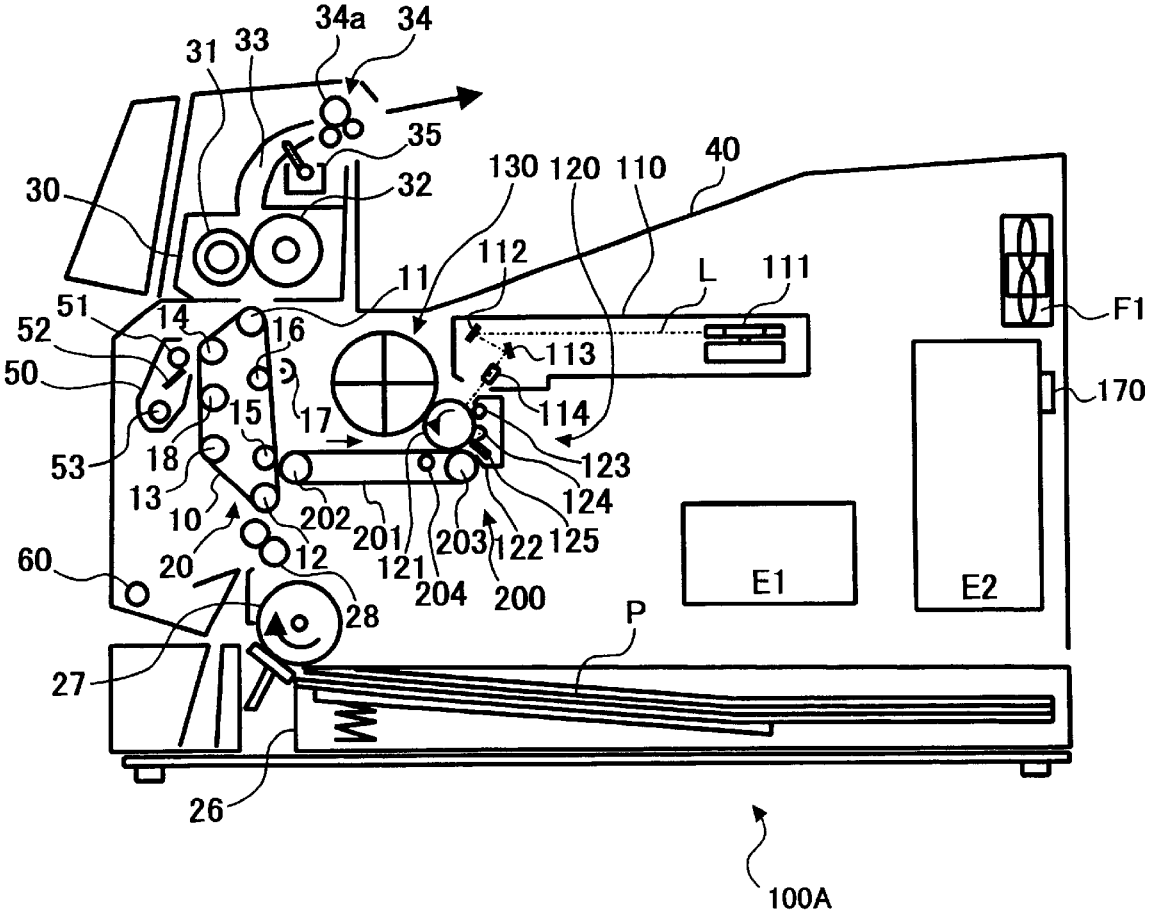
FIG. 9 is a schematic cross-sectional view of a printer according to another embodiment of the present invention.

FIG. 9 is a schematic cross-sectional view of a printer 100A. For the sake of simplification of the description, members having substantially the same functions as those used in the printer 100 of FIG. 1 are designated with the same reference characters and their description is omitted.

Referring to FIG. 9, the printer 100A includes a drum-shaped photoreceptor 121 serving as a first image bearing member at a substantially central part of the printer 100A in a vertical direction. Arranged around the photoreceptor 121 are a charging device 123, a discharging device 124, and a cleaning device 125. In this embodiment, the photoreceptor 121, the charging device 123, the discharging device 124, and the cleaning device 125 are integrally assembled in a process cartridge 120. The process cartridge 120 is replaced with a new one when its useful lifetime ends.

The charging device 123 is driven to rotate in a counter-clockwise direction in FIG. 9 by a drive device (not shown) to uniformly charge the surface of the photoreceptor 121 with a negative polarity. The uniformly charged surface of the photoreceptor 121 is exposed to laser light emitted from an exposure device 110 (details of which are described later), and thereby an electrostatic latent image is formed on the surface of the photoreceptor 121.

A revolver type developing device 130 (details of which are described later) develops the electrostatic latent image on the photoreceptor 121 with toner accommodated in the developing device 130 to form a toner image. The toner image on the photoreceptor 121 is transferred onto an intermediate transfer belt 201.

The cleaning device 125 removes unnecessary toner remaining on a surface of the photoreceptor 121 after the toner image is transferred from the photoreceptor 121 onto the intermediate transfer belt 201. After the cleaning device 125 removes residual toner from the photoreceptor 121, the surface of the photoreceptor 121 is uniformly discharged by the discharging device 124 to be prepared for a next image forming operation.

The exposure device 110 is arranged at a right side of the process cartridge 120 in FIG. 9. A laser light "L" emitted by the exposure device 110 according to image information irradiates the photoreceptor 121 at a writing position between the charging device 123 and the revolver type developing device 130.

Further, an intermediate transfer unit 200 is arranged below the process cartridge 120 in FIG. 9. The intermediate transfer unit 200 includes the endless intermediate transfer belt 201 serving as a second image bearing member, a drive roller 202 and a driven roller 203 around which the intermediate transfer belt 201 is spanned, and an intermediate transfer roller 204 that contacts a rear surface of the intermediate transfer belt 201. The intermediate transfer belt 201 is rotated in a clockwise direction in FIG. 9 by rotation of the drive roller 202 driven to rotate by a drive device (not shown). The photoreceptor 121 contacts the intermediate transfer belt 201, thereby an intermediate transfer nip part is formed between the photoreceptor 121 and the intermediate transfer belt 201. An intermediate transfer electric field is exerted in the intermediate transfer nip part by bringing the intermediate transfer roller 204, to which an intermediate transfer bias is applied from a power supply (not shown), into contact with the rear surface of the intermediate transfer belt 201.

Similarly as in the printer 100 of FIG. 1, a sheet feeding device is arranged below the intermediate transfer unit 200 in FIG. 9. The sheet feeding device includes the sheet feeding cassette 26, the sheet feeding roller 27, and the pair of registration rollers 28. The sheet feeding cassette 26 accommodates a plurality of transfer sheets P. The sheet feeding roller 27 contacts an uppermost transfer sheet P. When the sheet feeding roller 27 is driven to rotate in a clockwise direction in FIG. 9 by a drive device (not shown), the uppermost transfer sheet P is fed out to a nip part between the registration rollers 28. The transfer sheet P is further fed out by the registration rollers 28 toward a secondary transfer position (described later) at an appropriate timing.

Moreover, similarly as in the printer 100 of FIG. 1, the two-side transfer device 20 is arranged at a left side of the intermediate transfer unit 200 in FIG. 9. The two-side transfer device 20 includes the endless sheet conveying belt 10 serving as a recording medium holding member, the stretch rollers 11, 12, 13, and 14, the transfer roller 15, the rear-side supporting roller 16, the transfer charger 17, and the cooling device 18. The two-side transfer device 20 is configured such that the sheet conveying belt 10 contacts the intermediate transfer belt 201.

The transfer roller 15 is arranged such that the sheet conveying belt 10 is sandwiched between the intermediate transfer belt 201 and the transfer roller 15. The transfer roller 15 generates a secondary transfer electric field between the transfer roller 15 and the intermediate transfer belt 201 with voltage of a positive polarity applied to the transfer roller 15 from a power supply (not shown). A toner image on the intermediate transfer belt 201 is transferred onto the sheet conveying belt 10 or a transfer sheet P fed out from the registration rollers 28, by the influence of the secondary transfer electric field.

With the movements of the sheet conveying belt 10, the transfer sheet P having the toner image transferred from the intermediate transfer belt 201 thereto is conveyed toward the heat fixing device 30 arranged above the two side transfer device 20 in FIG. 9, after passing through a position where the sheet conveying belt 10 opposes the transfer charger 17.

Similarly as in the printer 100 of FIG. 1, the transfer sheet P is further conveyed to the heat fixing device 30 to fix the toner image onto the transfer sheet P, and is then discharged to the sheet discharging and stacking part 40 through the sheet discharging device 34.

The printer 100A according to the another embodiment of the present invention is configured to form not only an image on one side of a transfer sheet P, but to form images on both sides of a transfer sheet P by the following image forming process. The printer 100A is also configured to form full color images. First, a single color image forming process is described.

In the description of obtaining images on both sides of a transfer sheet P, an image that is first formed is referred to as a first side image, and an image that is later formed is referred to as a second side image. Further, a sheet side onto which the first side image is transferred is referred to as a first sheet side, and a sheet side onto which the second side image is transferred is referred to as a second sheet side.

Figure 10:
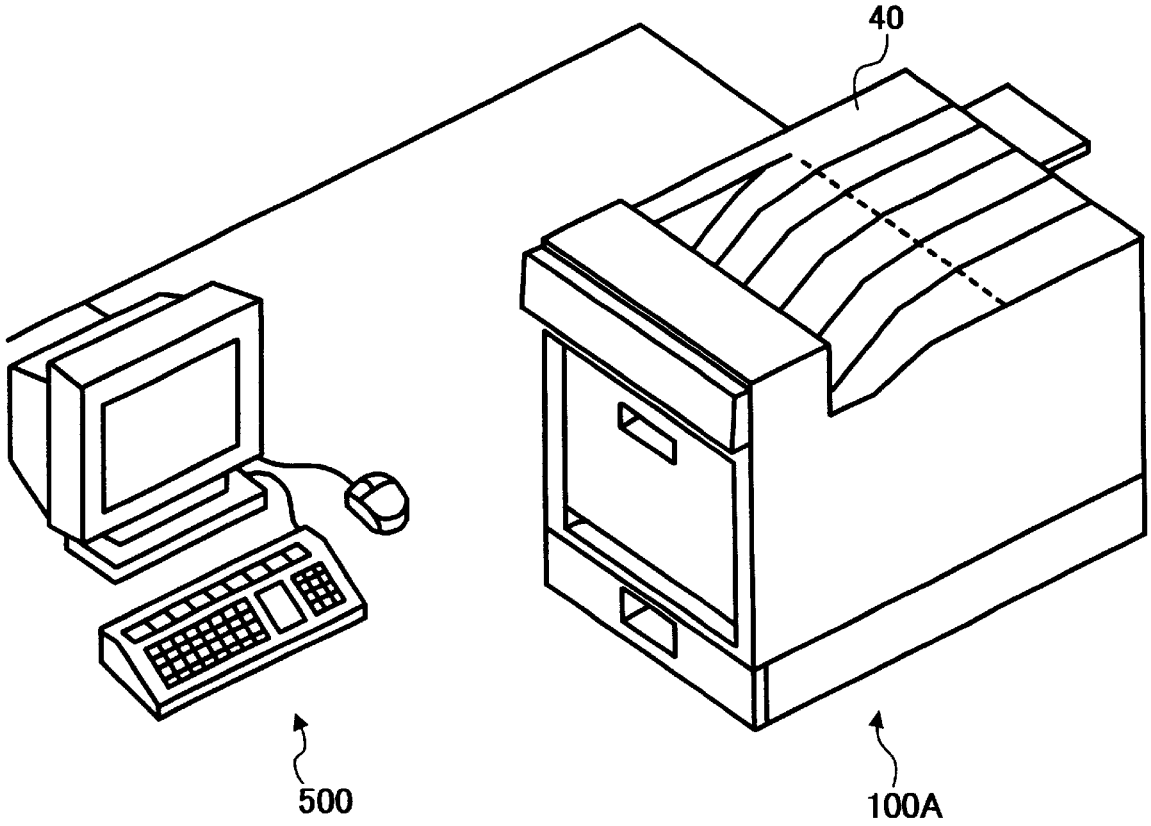
FIG. 10 is a perspective view of a host computer and the printer of FIG. 9.

As illustrated in FIG. 10, the printer 100A is configured to form images in accordance with a signal for writing an image sent from the host computer 500 through the interface 170 of the printer 100A. Again with reference to FIG. 9, the exposure device 110 is driven according to an image signal that has been received. A laser light "L" emitted from a laser light source (not shown) is deflected to scan by a polygonal mirror 111 rotated by being driven by a motor (not shown). The laser light "L" is irradiated onto the photoreceptor 121 that has been uniformly charged by the charging device 123 via mirrors 112 and 113, and a fθ lens 114, etc., so that an electrostatic latent image corresponding to writing information is formed on the photoreceptor 121.

The latent image on the photoreceptor 121 is developed with toner by the revolver type developing device 130, and thereby a visual image (i.e., a toner image) is formed and carried on the surface of the photoreceptor 121 as a first side image. A first side toner image on the photoreceptor 121 is transferred onto the intermediate transfer belt 201 at the intermediate transfer nip part. The first side toner image on the intermediate transfer belt 201 is conveyed to a secondary transfer position where the intermediate transfer belt 201 and the sheet conveying belt 10 contact each other, by rotation of the intermediate transfer belt 201.

At this time, a transfer sheet P is not fed to the secondary transfer position. The first side toner image on the intermediate transfer belt 201 is not transferred onto a transfer sheet P but onto the sheet conveying belt 10, which is being moved in synchronization with the rotation of the intermediate transfer belt 201. Subsequently, the sheet conveying belt 10 carrying the first side toner image moves one cycle and returns to the secondary transfer position.

While the sheet conveying belt 10 moves one cycle, subsequent exposure and developing processes start to form a second side toner image on the photoreceptor 121, and the second side toner image is transferred onto the intermediate transfer belt 201. A transfer sheet P is fed out from the sheet feeding cassette 26 to the registration rollers 28. Further, the registration rollers 28 feed out the transfer sheet P at an appropriate timing such that the first sheet side (a lower side in FIG. 9, i.e., a sheet surface opposing the sheet conveying belt 10) of the transfer sheet P and the first side toner image on the sheet conveying belt 10 that returns to the secondary transfer position are correctly aligned.

On the other hand, the second side toner image is formed on the photoreceptor 121 at an appropriate timing such that the second sheet side (an upper side in FIG. 9, i.e., a sheet surface opposing the intermediate transfer belt 201) of the transfer sheet P and the second side toner image on the intermediate transfer belt 201 are correctly aligned. Therefore, the transfer sheet P is sandwiched between the first side toner image on the sheet conveying belt 10 and the second side toner image on the intermediate transfer belt 201 at the secondary transfer position.

In this condition, the second side toner image on the intermediate transfer belt 201 is transferred onto the second sheet side of the transfer sheet P by the influence of the secondary transfer electric field generated by the transfer roller 15. At this time, even though the first side toner image contacts the first sheet side of the transfer sheet P, the first side toner image is not yet transferred onto the first sheet side of the transfer sheet P from the sheet conveying belt 10, because the first side toner image positioned between the sheet conveying belt 10 and the first sheet side of the transfer sheet P is attracted to the sheet conveying belt 10 by an electrostatic force generated by the secondary transfer electric field.

After passing the secondary transfer position, the transfer sheet P moves together with the sheet conveying belt 10 in a condition that the transfer sheet P carries the second side toner image transferred onto the second sheet side thereof at the secondary transfer position, and the first sheet side of the transfer sheet P contacts the first side toner image on the sheet conveying belt 10. When the transfer sheet P passes a position where the transfer sheet P opposes the transfer charger 17, the first side toner image is electrostatically transferred onto the first sheet side of the transfer sheet P from the sheet conveying belt 10. At this time, because a predetermined gap is formed between the second sheet side of the transfer sheet P and the transfer charger 17, the second side toner image on the second sheet side of the transfer sheet P is prevented from being transferred to the transfer charger 17.

As described above, the two-side transfer device 20 allows the first and second side toner images to be transferred onto the first and second sheet sides of the transfer sheet P, respectively, by the actions of the transfer roller 15 and the transfer charger 17. Thus, the two-side transfer device 20 functions as a device that transfers toner images onto both sides of a transfer sheet P.

When the first side toner image on the sheet conveying belt 10 passes a charge applying position of the transfer charger 17 not together with the transfer sheet P and the second side toner image, the transfer charger 17 is controlled to be in a non-operated state.

When a mirror image is formed on the photoreceptor 121 and the image is directly transferred onto a transfer sheet P, the image is obtained as a correct image on the transfer sheet P. When an image formed on the photoreceptor 121 is first transferred onto the intermediate transfer belt 201 and is then transferred onto a transfer sheet P, if the image is formed on the photoreceptor 121 as a mirror image, the image is obtained on the transfer sheet P as the mirror image. Therefore, in the embodiment, the exposure is performed such that the first side image, which is transferred from the photoreceptor 121 to the intermediate transfer belt 201 and is then transferred to the sheet conveying belt 10 and is then transferred onto a transfer sheet P, is formed on the photoreceptor 121 as a mirror image, and the second side image, which is transferred from the photoreceptor 121 to the intermediate transfer belt 201 and is then transferred onto the transfer sheet P, is formed as a correct image on the photoreceptor 121.

The transfer charger 17 may be arranged upstream of the secondary transfer position instead of downstream of the secondary transfer position in the moving direction of the sheet conveying belt 10. For example, if the polarity of the first side toner image carried on the sheet conveying belt 10 is reversed by an action of the transfer charger 17 provided at a position where the transfer charger 17 opposes the sheet conveying belt 10 between the stretch rollers 12 and 13, the first side toner image on the sheet conveying belt 10, which is positively charged, is transferred onto the transfer sheet P by electrostatic repulsion of the first toner image against the transfer roller 15 to which a positive transfer bias is applied, and the second side toner image is transferred from the intermediate transfer belt 201 to the transfer sheet P by electrostatic absorption of the negatively charged second side toner image to the transfer sheet P at the secondary transfer position.

Next, an image forming process of the printer 100A when obtaining an image on one side of a transfer sheet P is described. First, a toner image is formed on the photoreceptor 121 as a correct image and is transferred onto the intermediate transfer belt 201 at the intermediate transfer nip part. A transfer sheet P is fed out from the sheet feeding cassette 26 to the registration rollers 28. Further, the registration rollers 28 feed out the transfer sheet P to the secondary transfer position at an appropriate timing such that the toner image on the intermediate transfer belt 201 and the transfer sheet P are correctly aligned. Thereafter, the toner image is transferred onto the transfer sheet P (an upper side in FIG. 9, i.e., a sheet surface opposing the intermediate transfer belt 201) at the secondary transfer position. The transfer sheet P having the toner image is conveyed to the heat fixing device 30 without charge application by the transfer charger 17. After the toner image is fixed onto the transfer sheet P by the heat fixing device 30, the transfer sheet P having a fixed toner image is discharged to the sheet discharging and stacking part 40.

Now, description is made with respect to a feature of the construction of the printer 100A.

Figure 11:
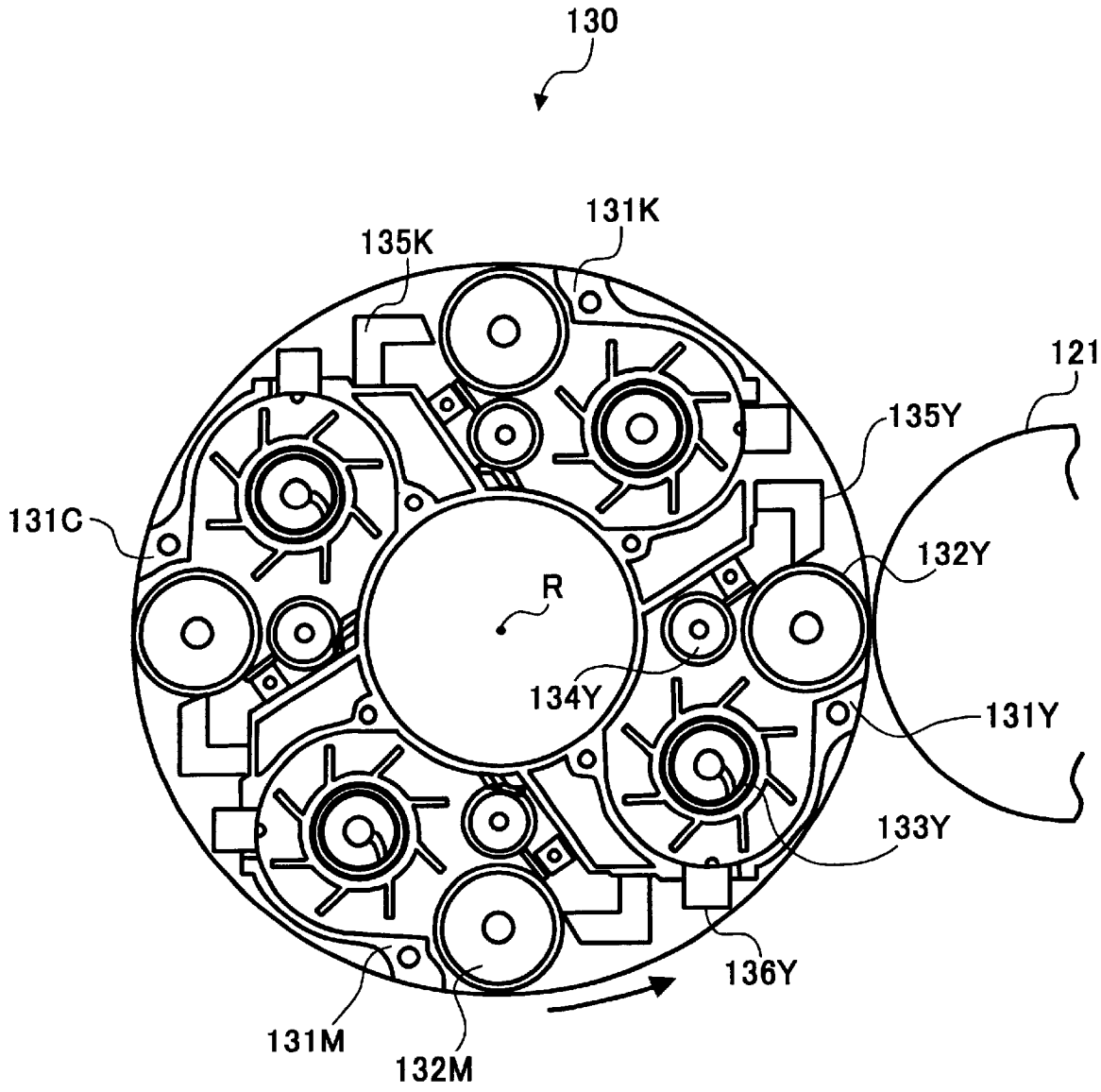
FIG. 11 is a schematic cross-sectional view of a revolver-type developing device of the printer of FIG. 9.

FIG. 11 is a cross-sectional view of the revolver type developing device 130 of the printer 100A according to the embodiment. Referring to FIG. 11, the revolver type developing device 130 is driven to rotate in a counterclockwise direction around a rotation center point "R" in FIG. 11. The revolver type developing device 130 includes four developing units 131Y, 131M, 131C, and 131K. In an illustrative example of the revolver type developing device 130, the developing unit 131Y for yellow is located at a developing position where the revolver type developing device 130 opposes the photoreceptor 121. In the order of counterclockwise direction in FIG. 11, there are provided the developing unit 131Y for yellow, the developing unit 131K for black, the developing unit 131C for cyan, and the developing unit 131M for magenta (hereinafter they may be referred to as the yellow developing unit 131Y, the black developing unit 131K, the cyan developing unit 131C, and the magenta developing unit 131M, respectively). The yellow developing unit 131Y contains two-component developer (hereinafter simply referred to as developer) including yellow toner and carrier, the black developing unit 131K contains black developer including black toner and carrier, the cyan developing unit 131C contains cyan developer including cyan toner and carrier, and the magenta developing unit 131M contains magenta developer including magenta toner and carrier.

The constructions of the developing units 131Y, 131M, 131C, and 131K are substantially the same. Therefore, the construction of the yellow developing unit 131Y located at the developing position in FIG. 11 is described as an example. The yellow developing unit 131Y includes a developing roller 132Y whose circumferential surface is partially exposed to the outside through an opening part to oppose the photoreceptor 121. The yellow developing unit 131Y further includes a doctor blade 135Y that regulates an amount of the yellow developer carried on the developing roller 132Y to be conveyed to the developing position where the developing roller 132Y opposes the photoreceptor 121.

The yellow developing unit 131Y further includes a developer conveying screw 134Y, a magnetic permeability sensor 136Y, and a paddle 133Y. The developer conveying screw 134Y conveys the yellow developer whose amount is regulated by the doctor blade 135Y from the rear side to the front side as seen in FIG. 11. The magnetic permeability sensor 136Y detects magnetic permeability of the yellow developer in the yellow developing unit 131Y. The paddle 133Y includes a plurality of paddle members on an outer periphery of a hollow cylindrical part of the paddle 133Y to agitate the yellow developer in the yellow developing unit 131Y. A plurality of developer discharging openings (not shown) are formed with the hollow cylindrical part of the paddle 133Y. Further, a developer conveying screw (not shown) is provided inside of the hollow cylindrical part of the paddle 133Y to convey the yellow developer from the front side to the rear side as seen in FIG. 11. A part of the yellow developer thus conveyed by the developer conveying screw is discharged from the hollow cylindrical part of the paddle 133Y through the above-described developer discharging openings. An appropriate amount of the yellow toner contained in a toner container (not shown) is replenished to the yellow developing unit 131Y according to a detected output of the magnetic permeability sensor 136Y.

By performing the following image forming process for a full color image, a full color first side toner image and a full color second side toner image are formed on the intermediate transfer belt 201 in the printer 100A. Specifically, the surface of the photoreceptor 121 is uniformly charged by the charging device 123 while the photoreceptor 121 is driven to rotate in a counterclockwise direction in FIG. 9. Subsequently, an electrostatic latent image is formed on the surface of the photoreceptor 121 by a scanning/exposing process by the exposure device 110 according to image information. The image information includes each of separated color image information for yellow, magenta, cyan, and black. The electrostatic latent image is formed for each of separated colors.

The electrostatic latent image for each of the separated colors is developed with color toner by the revolver type developing device 130, and thereby yellow, magenta, cyan, and black toner images are formed on the photoreceptor 121.

Particularly, an electrostatic latent image for yellow is formed on the photoreceptor 121, and is then developed with yellow toner by the yellow developing unit 131Y. Thereby, a yellow toner image is formed on the photoreceptor 121. The yellow toner image is then transferred onto the intermediate transfer belt 201 at the intermediate transfer nip part. Subsequently, an electrostatic latent image for magenta is formed on the photoreceptor 121. Before a leading edge of the electrostatic latent image for magenta is moved to a developing position by rotation of the photoreceptor 121, the revolver type developing device 130 is rotated in the counterclockwise direction in FIG. 11 by about 90°. By this rotation, the magenta developing unit 131M is situated at the developing position to form a magenta toner image on the photoreceptor 121 by developing the electrostatic latent image for magenta with magenta toner. The magenta toner image is transferred onto the intermediate transfer belt 201 to be superimposed with the yellow toner image.

In a similar manner, a cyan toner image and a black toner image are sequentially formed on the photoreceptor 121 and transferred onto the intermediate transfer belt 201 to be superimposed with the previously formed toner images. After the last black toner image is transferred onto the intermediate transfer belt 201 and superimposed with the previously formed toner images, a full color toner image of four colors is formed on the intermediate transfer belt 201.

A first side full color toner image and a second side full color toner image thus formed on the intermediate transfer belt 201 are respectively transferred onto the sheet conveying belt 10 and a transfer sheet P at the secondary transfer position as described earlier.

In the printer 100A thus constructed, toner images of respective colors are superimposed with each other not in the two-side transfer device 20 but in the intermediate transfer unit 200. The superimposed full color toner image is transferred onto the sheet conveying belt 10 or a transfer sheet P at the same time in the two-side transfer device 20. With this construction, it is not necessary to rotate the sheet conveying belt 10 holding the transfer sheet P many times for forming a superimposed full color toner image.

The intermediate transfer unit 200 includes a cleaning device (not shown) configured to be brought into contact with and separated from the intermediate transfer belt 201. The cleaning device is separated from the intermediate transfer belt 201 while the toner images of the respective colors are superimposed with each other on the intermediate transfer belt 201. The cleaning device is brought into contact with the intermediate transfer belt 201 at a timing after the superimposed full color toner image is transferred from the intermediate transfer belt 201 onto the sheet conveying belt 10 or a transfer sheet P at the secondary transfer position.

Figure 12:
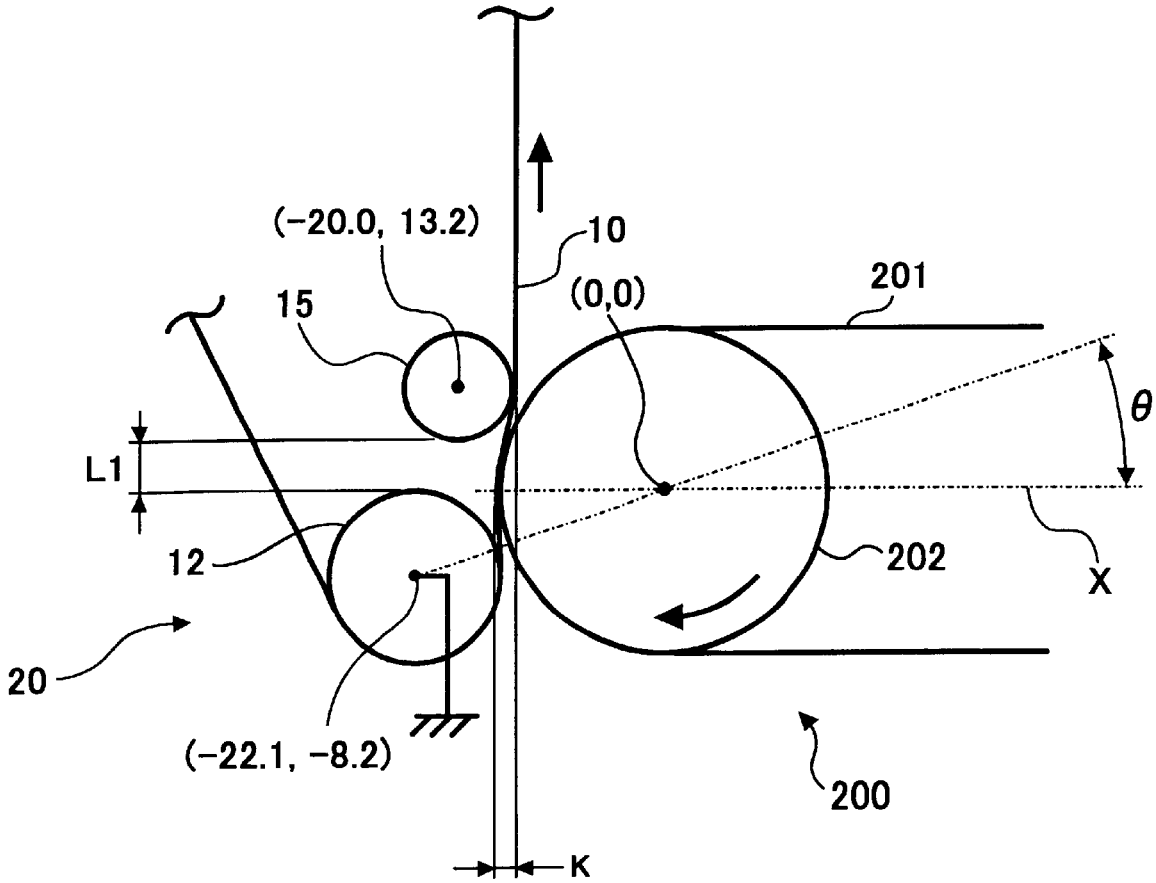
FIG. 12 is an enlarged view of a construction of a part of a two-side transfer device and an intermediate transfer belt of the printer of FIG. 9.

FIG. 12 is an enlarged view of a construction of a part of the two-side transfer device 20 and the intermediate transfer belt 201. Referring to FIG. 12 as an example structure, the stretch roller 12 has a diameter of about 16 mm, the transfer roller 15 has a diameter of about 10 mm, and the drive roller 202 has a diameter of about 30 mm.

When the coordinates of the central axis of the drive roller 202 is (0, 0), the stretch roller 12 having the diameter of about 16 mm is arranged such that the central axis of the stretch roller 12 is positioned at the coordinates (−22.1, −8.2). Further, the transfer roller 15 having the diameter of about 10 mm is arranged such that the central axis of the transfer roller 15 is positioned at the coordinates (−20.0, 13.2).

The line connecting the central axis of the drive roller 202 and the central axis of the roller 12 and a horizontal line X form an angle θ of 20° therebetween. The arrangement position of the two-side transfer device 20 relative to the drive roller 202 is set such that the intermediate transfer belt 201 intrudes into a part of the sheet conveying belt 10 spanning the stretch roller 12 and the transfer roller 15 by an intrusion amount K of about 0.54 mm, as in the FIGS. 1 and 3 embodiment.

In the above-described two-side transfer device 20 thus constructed, the part of the sheet conveying belt 10 spanning the stretch roller 12 and the transfer roller 15 is positively biased against the drive roller 202 by the stretch roller 12 and the transfer roller 15. Thereby, the above-described part of the sheet conveying belt 10 is adequately wrapped around a part of the outer circumference of the drive roller 202. In this embodiment, the sheet conveying belt 10 is wrapped around about one-tenth of the peripheral length of the drive roller 202, thereby forming a secondary transfer nip part having a width of about 8.7 mm. In the case of forming such a secondary transfer nip part, as compared to a point contact of the intermediate transfer belt 201 and the sheet conveying belt 10 at the secondary transfer position, the intermediate transfer belt 201 and the sheet conveying belt 10 securely contact each other at the secondary transfer position, so that occurrence of blurring of a toner image transferred from the intermediate transfer belt 201 onto the sheet conveying belt 10 or a transfer sheet P due to unstable contact condition of the intermediate transfer belt 201 and the sheet conveying belt 10 at the secondary transfer position may be restrained.

As seen from FIG. 18, when the intrusion amount of the intermediate transfer belt 201 into the sheet conveying belt 10 by use of the drive roller 202 is less than 0.2 mm, the transfer rate of 90% or greater is not obtained. That results because when the intrusion amount of the intermediate transfer belt 201 into the sheet conveying belt 10 by the use of the drive roller 202 is less than 0.2 mm, the contact of the intermediate transfer belt 201 and the sheet conveying belt 10 is not sufficient, resulting in an inferior transfer of a toner image. In the printer 100A according to the embodiment of the present invention, because the intrusion amount K is set to 0.2 mm or greater (i.e., about 0.54 mm), the transfer rate of 90% or greater can be obtained.

As illustrated in FIG. 19, the lifting amount of the 180K sheet sharply increases after the intrusion amount of the intermediate transfer belt 201 into the sheet conveying belt 10 by use of the drive roller 202 exceeds 0.6 mm. When a transfer sheet P is curled at the secondary transfer nip part, a sheet jam tends to occur, and an inferior transfer of a toner image tends to occur when the first side toner image on the sheet conveying belt 10 is transferred onto the first sheet side of the transfer sheet P by the action of the transfer charger 17, due to an insufficient contact of the first side toner image and the transfer sheet P.

Therefore, the intrusion amount K is set to 0.6 mm or less (i.e., about 0.54 mm) in the printer 100A, and thereby the above-described inferior transfer of a toner image and sheet jam is typically avoided.

With respect to the stretch roller 12 and the transfer roller 15, which serve to form the secondary transfer nip part, respective materials, cross-section constructions, lengths, and diameters of the stretch roller 12 and the transfer roller 15 are preferably set such that respective flexibility amounts of the stretch roller 12 and the transfer roller 15 by the tension of the sheet conveying belt 10 are suppressed to 0.5 mm or less.

Specifically, each flexibility amount "y" (mm) of the stretch roller 12 and the transfer roller 15 is obtained by the following calculation:

$$y=-(5WL^4)/(384EI),$$

where "W" (kg/mm) is weight per unit length, "L" (mm) is a length of a part of each roller where weight is applied by the sheet conveying belt 10, "E" (kg/mm$^2$) is Young's modulus, and "I" (mm$^4$) is geometrical moment of inertia.

The length "L" of the part of each roller where weight is applied by the sheet conveying belt 10 and the geometrical moment of inertia "I" are preferably set such that the flexibility amount "y" of each roller is suppressed to 0.5 mm or less. Further, a material of each roller is preferably selected such that the Young's modulus "E" and the weight per unit length "W" allow the flexibility amount "y" of each roller to be 0.5 mm or less.

By suppressing the flexibility amount "y" of the stretch roller 12 and the transfer roller 15 to 0.5 mm or less, meanders of the sheet conveying belt 10 at the secondary transfer nip part may be prevented.

The geometrical moment of inertia "I" is obtained by the following calculation:

$$I=\pi(D1^4-D2^4)/64,$$

where D1 is an outer diameter of a roller and D2 is an inner diameter of a roller.

In this embodiment, the printer 100A can employ a transfer roller 15 that is a conductive solid (not hollow) roller made of stainless and has a diameter of about 10 mm. By use of such a transfer roller 15, the flexibility amount "y" of the transfer roller 15 is suppressed to 0.5 mm or less. Further, the printer 100A can employ a stretch roller 12 that is a solid (not hollow) roller made of stainless and has a diameter of about 16 mm. By use of such a stretch roller 12, the flexibility amount "y" of the stretch roller 12 is suppressed to 0.5 mm or less.

Further, the charging of the stretch roller 12 due to friction between the sheet conveying belt 10 and the stretch roller 12 is obviated by grounding the stretch roller 12. In this embodiment, a secondary transfer bias of 7 kV or less can be applied to the transfer roller 15. In this condition, an electric discharge between the transfer roller 15 and the stretch roller 12 is obviated by separating the transfer roller 15 from the stretch roller 12 by a distance L1 in FIG. 12 of about 5 mm or more. Particularly, the distance L1 can be set to about 7 mm in this embodiment.

Figure 13:
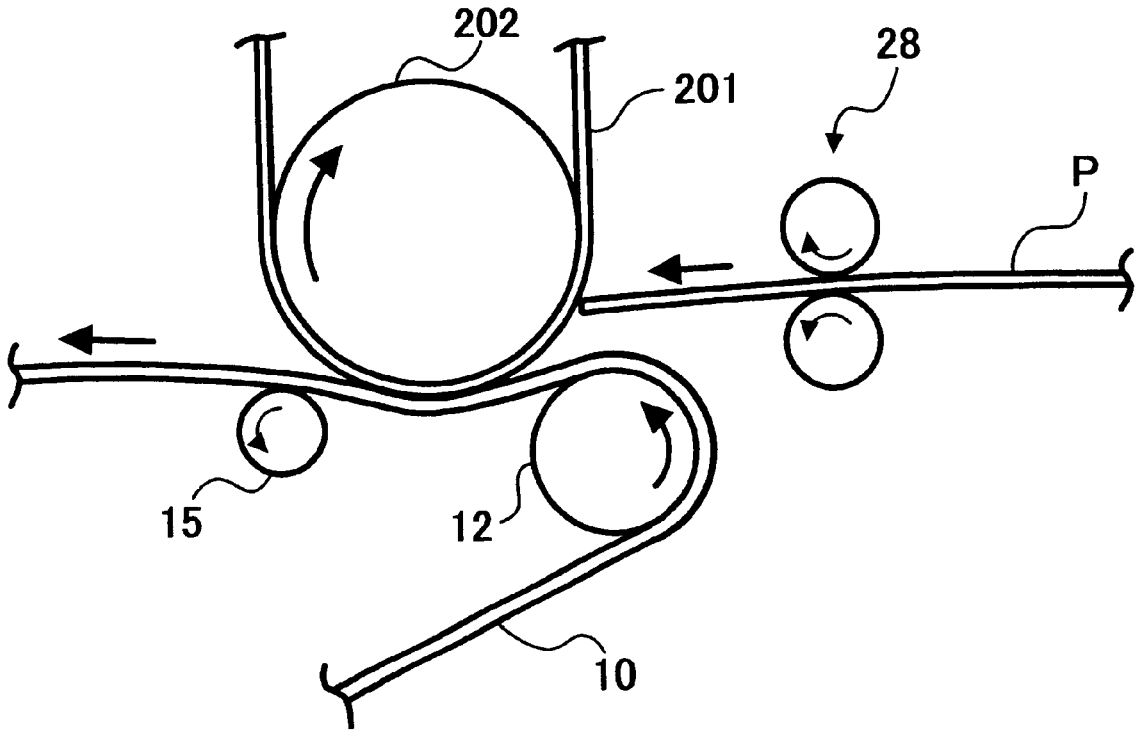
FIG. 13 is a schematic view of a pair of registration rollers and a secondary transfer nip part between the intermediate transfer belt and a sheet conveying belt in the printer of FIG. 9.

FIG. 13 is a schematic view of the registration rollers 28 and the secondary transfer nip part between the intermediate transfer belt 201 and the sheet conveying belt 10. As illustrated in FIG. 13, the registration rollers 28 are arranged at a position such that a leading edge of a transfer sheet P fed from the sheet feeding cassette 26 contacts the intermediate transfer belt 201 before contacting the sheet conveying belt 10. In such an arrangement of the registration rollers 28, as compared to a case in which a leading edge of a transfer sheet P fed from the sheet feeding cassette 26 contacts the sheet conveying belt 10 before contacting the intermediate transfer belt 201, a toner image may be properly transferred from the intermediate transfer belt 201 to the transfer sheet P.

Figure 14A:
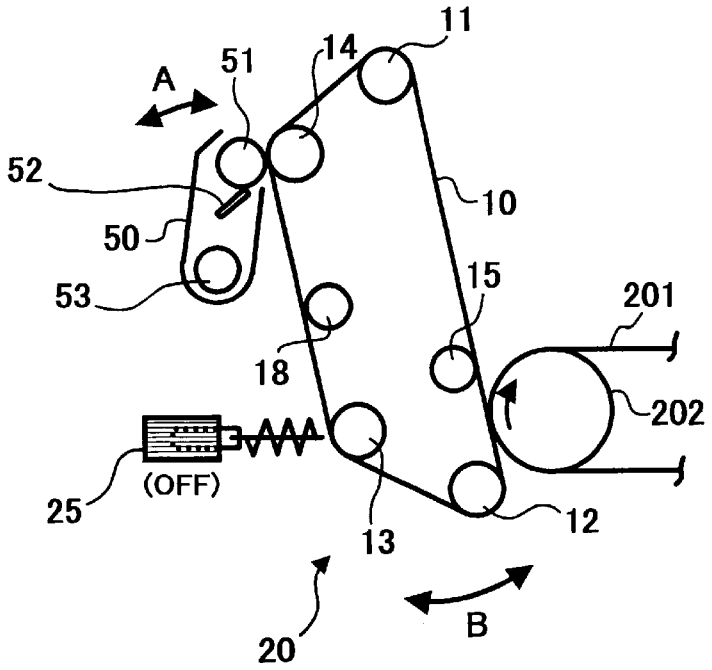
FIGS. 14A and 14B are schematic views for explaining a contacting/separating mechanism in the two-side transfer device according to the another embodiment of the present invention.
Figure 14B:
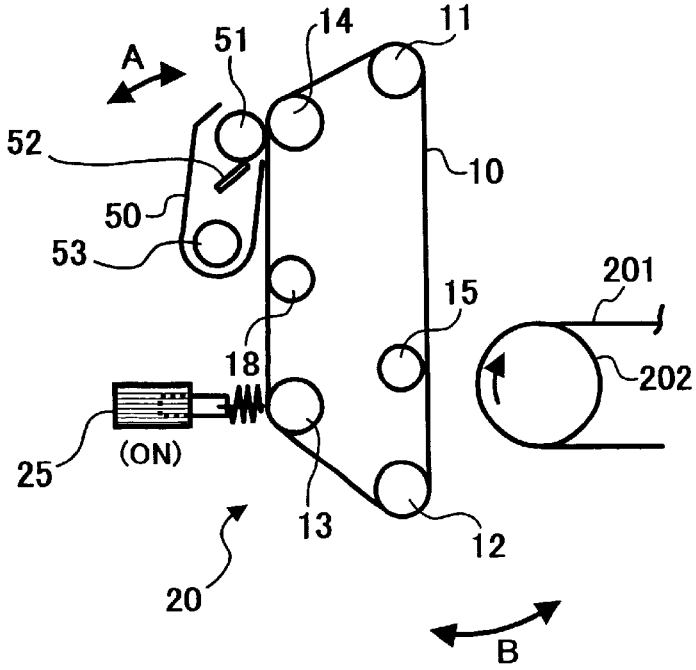

As shown in FIGS. 14A and 14B, the above-described two-side transfer device 20 includes the solenoid 25 serving as a contacting/separating device that contacts and separates the two-side transfer device 20 with and from the intermediate transfer belt 201. The stretch roller 11 of the two-side transfer device 20 is a drive roller that drives the sheet conveying belt 10 to rotate. As illustrated in FIGS. 14A and 14B, the two-side transfer device 20 swings around the stretch roller 11 in a direction indicated by a double-headed arrow B by an ON/OFF operation of the solenoid 25.

The belt cleaning unit 50 arranged at a position where the sheet conveying belt 10 is sandwiched between the belt cleaning unit 50 and the stretch roller 14 of the two-side transfer device 20 is configured to swing around the toner conveying screw 53 in a direction indicated by a double-headed arrow A in FIGS. 14A and 14B by the contacting/separating mechanism (not shown).

When the two-side transfer device 20 is swung leftward in FIG. 14B around the stretch roller 11 by turning on the solenoid 25, the belt cleaning unit 50 is biased by the stretch roller 14, and thereby the belt cleaning unit 50 is inclined leftward in FIG. 14B around the toner conveying screw 53. As illustrated in FIG. 14B, when the two-side transfer device 20 and the belt cleaning unit 50 are swung and inclined as described above, the sheet conveying belt 10 is separated from the intermediate transfer belt 201. As a result, the secondary transfer nip part does not exist between the intermediate transfer belt 201 and the sheet conveying belt 10 as illustrated in FIG. 14B.

On the other hand, by turning off the solenoid 25, the two-side transfer device 20 is swung rightward in FIG. 14A around the stretch roller 11. At substantially the same time, the belt cleaning unit 50 is swung rightward in FIG. 14A around the toner conveying screw 53 by the contacting/separating mechanism (not shown). Thereby, the sheet conveying belt 10 contacts the intermediate transfer belt 201 as illustrated in FIG. 14A.

As described above, in the printer 100A according to the FIG. 9 embodiment of the present invention, the sheet conveying belt 10 is configured to be separated from the intermediate transfer belt 201 by the contacting/separating device if necessary. Therefore, loads on the sheet conveying belt 10 and the intermediate transfer unit 200 may be reduced, and the transfer performance of the two-side transfer device 20 may be properly maintained. Further, a foreign substance clogged in the secondary transfer nip part may be easily removed therefrom.

It is preferable that the sheet conveying belt 10 be brought into contact with the intermediate transfer belt 201 during at least a period of time in which the first side toner image and the second side toner image on the intermediate transfer belt 201 pass a position where the first side toner image and the second side toner image oppose the sheet conveying belt 10 by rotation of the intermediate transfer belt 201. By contacting the sheet conveying belt 10 and the intermediate transfer belt 201 in the above-described period of time, the first side toner image and the second side toner image on the intermediate transfer belt 201 may surely enter the secondary transfer nip part.

It is more preferable that a contact condition of the sheet conveying belt 10 and the intermediate transfer belt 201 be maintained during a period of time in which a toner image on the photoreceptor 121 is transferred to the intermediate transfer belt 201 in addition to the above-described period of time. Thereby, toner images are not disturbed at the intermediate transfer nip part by vibrations caused by contacting and separating the sheet conveying belt 10 from the intermediate transfer belt 201. As a result, image blurring is prevented.

It is still more preferable that a sheet jam detecting device be provided to detect an occurrence of sheetjam in a sheet conveying path from the sheet feeding cassette 26 to the sheet discharging and stacking part 40. When the sheet jam detecting device detects an occurrence of sheet jam, the sheet conveying belt 10 is separated from the intermediate transfer belt 201.

As an example of the sheet jam detecting device, as illustrated in FIG. 9, the sheet detecting sensor 35 such as a photosensor may be provided in the vicinity of the sheet discharging device 34. When the sheet detecting sensor 35 does not detect a transfer sheet P after a predetermined time has elapsed from when the sheet feeding roller 27 feeds out the transfer sheet P, it is judged that a sheetjam occurs in a sheet conveying path. Even if a transfer sheet P is jammed in the secondary transfer nip part, the transfer sheet P may be easily removed from the sheet conveying path by separating the sheet conveying belt 10 from the intermediate transfer belt 201 based on a detection output of the sheet jam detecting device.

As described above, the secondary transfer nip part is formed between the sheet conveying belt 10 and the intermediate transfer belt 201 by use of the transfer roller 15 and the stretch roller 12. However, the transfer roller 15 is not necessarily used for the secondary transfer nip part.

Figure 15:
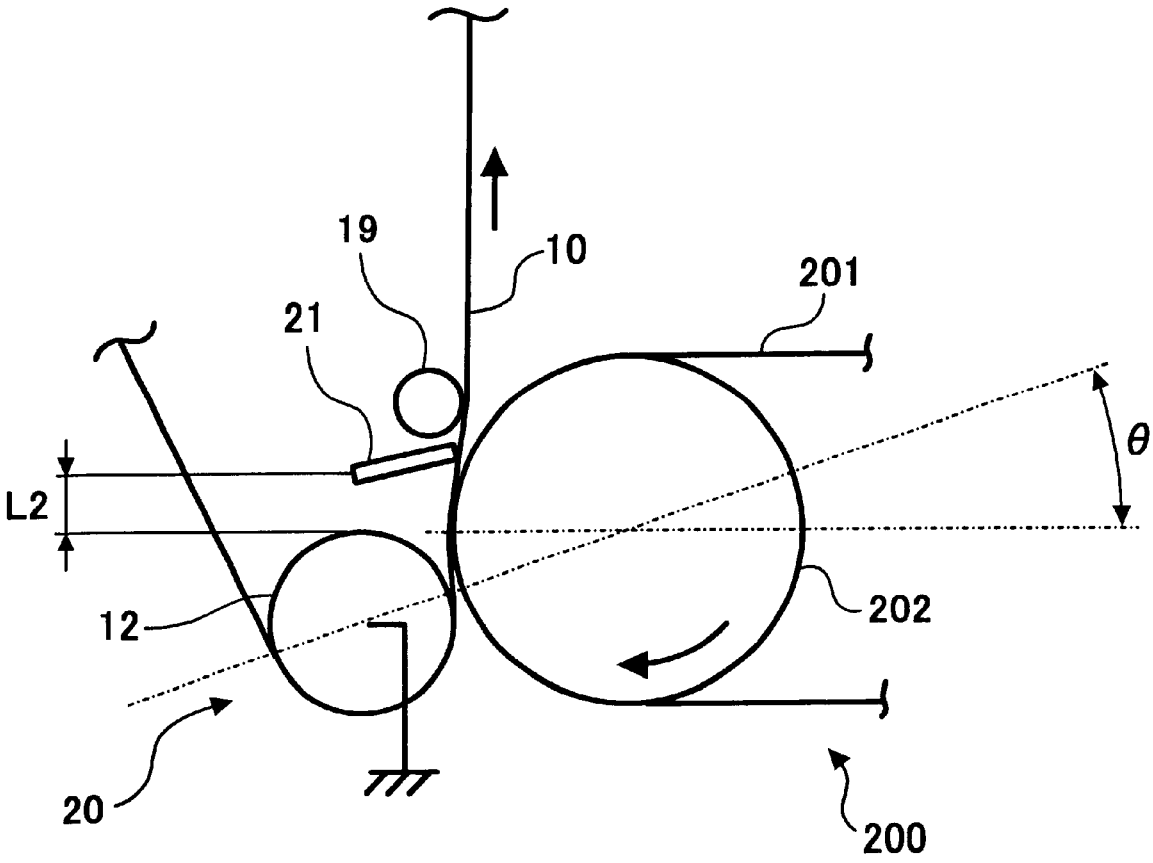
FIG. 15 is a schematic view of a part of the two-side transfer device and the intermediate transfer belt according to an alternative example.

FIG. 15 is a schematic view of a part of the two-side transfer device 20 and the intermediate transfer belt 201 according to an alternative example. In this alternative example, a secondary transfer nip part is formed by arranging the intermediate transfer unit 200 and the two-side transfer device 20 such that the intermediate transfer belt 201 intrudes into a part of the sheet conveying belt 10 spanning the stretch roller 19 and the stretch roller 12 as illustrated in FIG. 15. Further, the conductive brush 21 is arranged in the two-side transfer device 20 such that the conductive brush 21 contacts a rear surface of the sheet conveying belt 10 between the stretch rollers 19 and 12. A secondary transfer bias is applied to the sheet conveying belt 10 by the conductive brush 21. The conductive brush 21 contacts the sheet conveying belt 10 at a position downstream of the center of the drive roller 202 in the moving direction of a transfer sheet P by a distance "L2". In this alternative example, the distance "L2" is set to about 8 mm. The conductive brush 21 contains foreign substances sandwiched between the sheet conveying belt 10 and the conductive brush 21 in its flexible brushes, thereby decreasing damage to the sheet conveying belt 10 due to foreign substances sandwiched between the sheet conveying belt 10 and the conductive brush 21.

In the FIG. 9 embodiment, beside the process cartridge 120, the two-side transfer device 20 is configured so as to be replaced with a new one when its useful lifetime ends in a similar manner as described in the printer 100 referring to FIG. 8.

Next, a printer as an image forming apparatus to which the present invention is applied according to another embodiment of the present invention is described.

Figure 16:
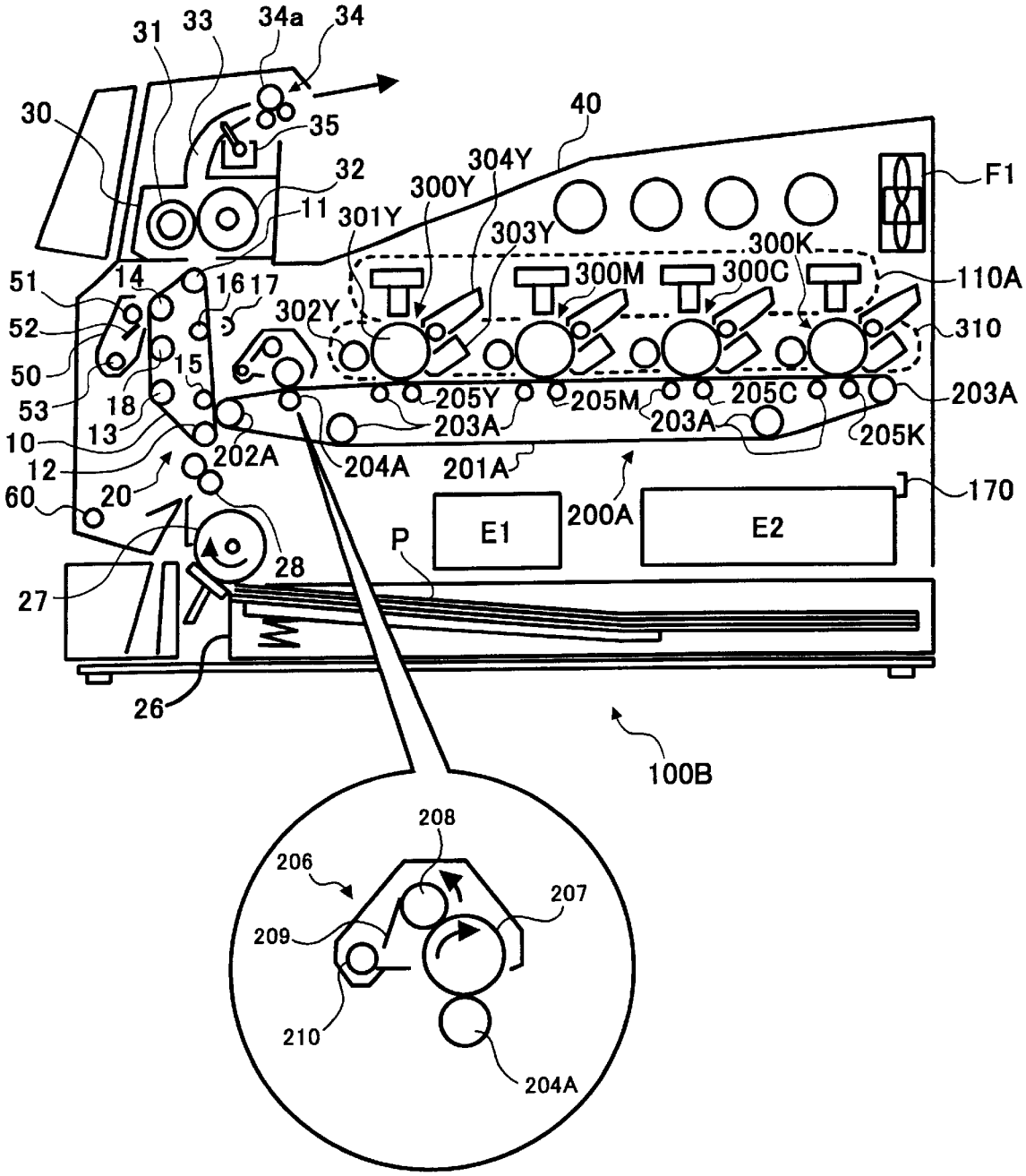
FIG. 16 is a schematic cross-sectional view of a printer according to another embodiment of the present invention.

FIG. 16 is a schematic cross sectional view of a printer 10B. The construction of the printer 100B is similar to that of the printer 100A of FIG. 9, and therefore members having substantially the same functions as those used in the printer 100A of FIG. 9 are designated with the same reference characters and their description is omitted.

As illustrated in FIG. 16, the printer 100B includes four photoreceptor units 300Y, 300M, 300C, and 300K instead of the revolver type developing device 130 of the printer 100A. The photoreceptor units 300Y, 300M, 300C, and 300K form a yellow toner image, a magenta toner image, a cyan toner image, and a black toner image, respectively. The constructions of the photoreceptor units 300Y, 300M, 300C, and 300K are substantially the same except that the photoreceptor units 300Y, 300M, 300C, and 300K form toner images of different colors. The construction of the photoreceptor unit 300Y is described as a representative example.

The photoreceptor unit 300Y includes a drum-shaped photoreceptor 301Y serving as a first image bearing member, a charging roller 302Y that uniformly charges the photoreceptor 301Y, a cleaning device 303Y, and a developing device 304Y. The photoreceptor units 300Y, 300M, 300C, and 300K are integrally assembled in a process cartridge 310. The process cartridge 310 is replaced with a new one when its useful lifetime ends.

An exposure device 110A is configured to individually expose the photoreceptors 301Y, 301M, 301C, and 301K. For example, when forming a yellow toner image, the exposure device 110A exposes the photoreceptor 301Y uniformly charged by the charging roller 302Y, thereby forming an electrostatic latent image for yellow. The electrostatic latent image for yellow is developed with yellow toner by the developing device 304Y, so that a yellow toner image is formed on the photoreceptor 301Y. In a similar manner, a magenta toner image, a cyan toner image, and a black toner image are formed on the photoreceptors 301M, 301C, and 301K, respectively.

An intermediate transfer unit 200A includes an intermediate transfer belt 201A spanning a drive roller 202A, seven driven rollers 203A, and a cleaning back up roller 204A. The photoreceptor units 300Y, 300M, 300C, and 300K are arranged so that the respective photoreceptors 301Y, 301M, 301C, and 301K contact the intermediate transfer belt 201A and form transfer nip parts between the photoreceptors 301Y, 301M, 301C, and 301K and the intermediate transfer belt 201A, respectively. Further, intermediate transfer bias rollers 205Y, 205M, 205C, and 205K abut a rear surface of the intermediate transfer belt 201A at the respective transfer nip parts. The yellow toner image, the magenta toner image, the cyan toner image, and the black toner image formed on the photoreceptors 301Y, 301M, 301C, and 301K are sequentially transferred onto the intermediate transfer belt 201A by influence of the transfer bias applied from the intermediate transfer bias rollers 205Y, 205M, 205C, and 205K and nip pressure, and are superimposed on each other on the intermediate transfer belt 201A. Similarly as in the printer 100A of FIG. 9, the superimposed full color toner image on the intermediate transfer belt 201A is transferred onto the sheet conveying belt 10 or a transfer sheet P at the same time at the secondary transfer position.

The intermediate transfer unit 200A includes a belt cleaning device 206 that removes unnecessary toner remaining on a surface of the intermediate transfer belt 201A after the superimposed full color toner image is transferred from the intermediate transfer belt 201A onto the sheet conveying belt 10 or a transfer sheet P at the secondary transfer position.

As illustrated in FIG. 16, the belt cleaning device 206 includes a brush roller 207 that rotates with the intermediate transfer belt 201A sandwiched between the cleaning back-up roller 204A and the brush roller 207. The belt cleaning device 206 further includes a bias roller 208 that rotates in contact with the brush roller 207, a blade 209 that abuts the bias roller 208, and a conveying screw 210. The brush roller 207 scrapes off the residual toner from the intermediate transfer belt 201A by the rotation thereof. The scraped off toner is transferred onto the bias roller 208 by the bias applied thereto. Then, the blade 209 scrapes off the toner from the bias roller 208. The scraped off toner is conveyed to a collecting part (not shown) by the conveying screw 210 so as to be appropriately disposed of.

As compared to the printer 100A of FIG. 9, the printer 100B of FIG. 16 may perform an image forming process at a higher speed. Specifically, in the printer 100A of FIG. 9, because the printer 100A includes a single photoreceptor 121, it is necessary to form each color toner image on the photoreceptor 121 serially in time. Therefore, for example, until a yellow toner image is transferred from the photoreceptor 121 onto the intermediate transfer belt 201, an image formation of a succeeding color toner image (i.e., a magenta toner image in the embodiment) may not be started.

On the other hand, in the printer 100B of FIG. 16, the printer 100B includes the photoreceptors 301Y, 301M, 301C, and 301K for forming respective color toner images. Therefore, the photoreceptors 301Y, 301M, 301C, and 301K may respectively form a yellow toner image, a magenta toner image, a cyan toner image, and a black toner image at substantially the same time. However, because the four photoreceptor units 300Y, 300M, 300C, and 300K are provided in the printer 100B, the printer 100B has a disadvantage in increased size and cost of the apparatus as compared to the printer 100A of FIG. 9.

In the printer 100B of FIG. 16, the photoreceptor units 300Y, 300M, 300C, and 300K and the exposure device 110A are arranged at an upper side of the intermediate transfer unit 200A in a vertical direction. Alternatively, the photoreceptor units 300Y, 300M, 300C, and 300K and the exposure device 110A may be arranged at a lower side of the intermediate transfer unit 200A in a vertical direction.

In the case that the photoreceptor units 300Y, 300M, 300C, and 300K and the exposure device 110A are arranged at a lower side of the intermediate transfer unit 200A in a vertical direction, the distance in which the superimposed full color toner image on the intermediate transfer belt 201A reaches a secondary transfer nip part formed between the intermediate transfer belt 201A and the sheet conveying belt 10 may be decreased. Therefore, an image forming process may be changed to a next image forming process in a relatively short time, so that a speed of image formation may be further increased. However, in this case, because a light emitting opening of the exposure device 110A directs upward, and the photoreceptor units 300Y, 300M, 300C, and 300K are arranged above the exposure device 11A, the exposure device 110A may be stained by toner dropped from the photoreceptor units 300Y, 300M, 300C, and 300K.

Similarly as in the printer 100A of FIG. 9, in the printer 100B of FIG. 16, the arrangement position of the two-side transfer device 20 relative to the drive roller 202A is set such that the intermediate transfer belt 201A intrudes into a part of the sheet conveying belt 10 spanning the stretch roller 12 and the transfer roller 15 by an intrusion amount K of 0.6 mm or less (e.g., about 0.54 mm). Further, the registration rollers 28 are arranged at a position such that a leading edge of a transfer sheet P fed from the sheet feeding cassette 26 contacts the intermediate transfer belt 201A before contacting the sheet conveying belt 10.

Further, in this embodiment, the two-side transfer device 20 is configured to be brought into contact with and separated from the intermediate transfer belt 201A by an ON/OFF operation of the solenoid 25 in a similar manner as described in the printer 100A referring to FIGS. 14A and 14B.

In the FIG. 16 embodiment, beside the process cartridge 310, the two-side transfer device 20 is configured to be replaced with a new one when its useful lifetime ends in a similar manner as described in the printer 100 referring to FIG. 8.

Figure 17:
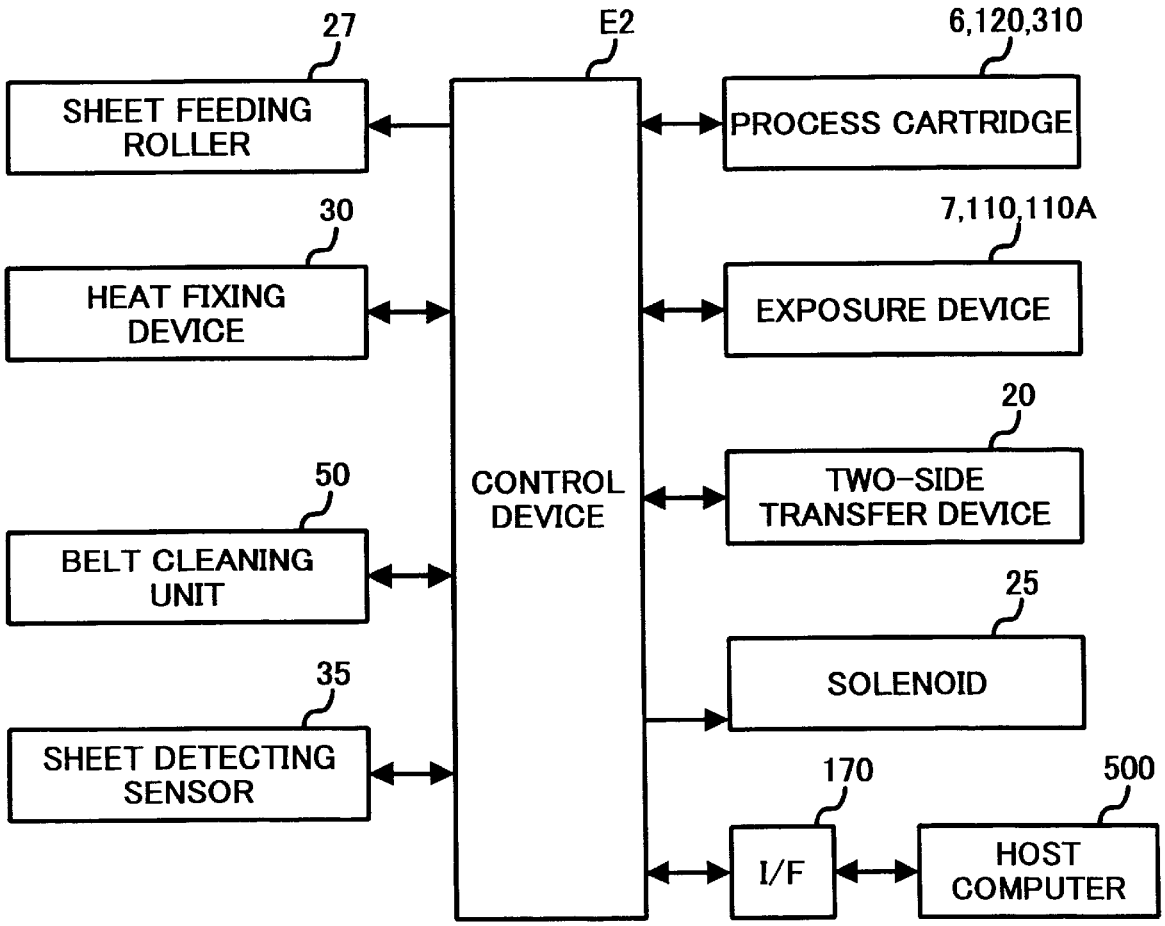
FIG. 17 is a block diagram illustrating a part of an electric circuit of the printers according to the embodiments of the present invention.

FIG. 17 is a block diagram illustrating a part of an electric circuit of the printers 100, 100A, and 100B according to the embodiments of the present invention. Referring to FIG. 17, the control device E2 is connected to the process cartridges (6, 120, 310), the exposure devices (7, 110, 110A), the two-side transfer device 20, the solenoid 25, the sheet feeding roller 27, the heat fixing device 30, and the belt cleaning unit 50. Though not shown in FIG. 17, the control device E2 is also connected to the revolver type developing device 130 in the printer 100A.

The control device E2 controls the solenoid 25 to drive so that the sheet conveying belt 10 is brought into contact with or separated from the photoreceptor 1, the intermediate transfer belt 201, or the intermediate transfer belt 201A.

Specifically, in the printer 100 of FIG. 1, the control device E2 controls the solenoid 25 to drive so that the sheet conveying belt 10 contacts the photoreceptor 1 during at least a period of time in which the first side toner image and the second side toner image on the photoreceptor 1 pass a position where the first side toner image and the second side toner image oppose the sheet conveying belt 10 by rotation of the photoreceptor 1. In the printer 100A of FIG. 9 and the printer 100B of FIG. 16, the control device E2 controls the solenoid 25 to drive so that the sheet conveying belt 10 contacts the intermediate transfer belt 201 or 201A during a period of time in which the first side toner image and the second side toner image on the intermediate transfer belt 201 or 201A pass a position where the first side toner image and the second side toner image oppose the sheet conveying belt 10 by rotation of the intermediate transfer belt 201 or 201A.

In the printer 100, the control device E2 further controls the solenoid 25 to maintain a contact condition of the sheet conveying belt 10 and the photoreceptor 1 during a period of time in which exposure and developing processes are performed on the photoreceptor 1. In the printers 100A and 100B, the control device E2 further controls the solenoid 25 to maintain a contact condition of the sheet conveying belt 10 and the intermediate transfer belt 201 or 201A during a period of time in which a toner image on the photoreceptor 121 or 301(Y, M, C, and K) is transferred to the intermediate transfer belt 201 or 201A.

The control device E2 is also connected to the sheet detecting sensor 35. The sheet detecting sensor 35 detects a transfer sheet P discharged from the sheet discharging device 34. The above-described sheet jam detecting device is constructed with the control device E2 and the sheet detecting sensor 35. As described above, when the sheet detecting sensor 35 does not detect a transfer sheet P after a predetermined time has elapsed from when the sheet feeding roller 27 feeds out the transfer sheet P, the control device E2 judges that a sheet jam occurs in a sheet conveying path. When the control device E2 judges an occurrence of sheet jam, the control device E2 controls the solenoid 25 to drive so that the sheet conveying belt 10 is separated from the photoreceptor 1, the intermediate transfer belt 201, or the intermediate transfer belt 201A.

The control device E2 receives a control signal for forming an image sent from the host computer 500 through the interface 170 of the printers 100, 100A, and 100B. The control device E2 controls the exposure devices (7, 110, 100A), the process cartridges (6, 120, 310), the two-side transfer device 20, the heat fixing device 30, etc. to drive according to the control signal received through the interface 170.

According to the embodiments of the present invention, the photoreceptor 1 and the sheet conveying belt 10 or the intermediate transfer belts 201/201A and the sheet conveying belt 10 securely contact each other at the transfer position. Therefore, an inferior transfer of a toner image such as occurrence of blurring of a toner image due to unstable contact condition of the photoreceptor 1 and the sheet conveying belt 10 or the intermediate transfer belts 201/201A and the sheet conveying belt 10 at the transfer position is typically prevented.

The present invention has been described with respect to the embodiments illustrated in the figures. However, the present invention is not limited to the embodiments and may be practiced otherwise.

For example, when recording images on both sides of a transfer sheet P, instead of turning one rotation the sheet conveying belt 10 carrying thereupon a first side toner image, the sheet conveying belt 10 can be rotated in the reverse direction to convey the first side toner image to a transfer position.

In the above embodiments, a transfer bias is applied to the transfer roller 15. However, a transfer bias may be applied to the stretch roller 12 instead of the transfer roller 15. In this case, the roller 15 needs to be grounded.

Further, in the above embodiments, the first image bearing member (i.e., the photoreceptor) is configured to be a drum. However, the first image bearing member can be configured to be a belt. The charging polarity of the photoreceptors 1, 121, and 301(Y, M, C, and K) and the toner, and the polarity of the transfer voltage are examples and can be reversed, respectively.

Further, as an alternative to the sheet conveying belt 10, a sheet conveying roller may be employed as a recording medium holding member.

Further, in the above embodiments, the exposure devices 7, 110, and 110A use a laser system. However, an LED system may be also used.

Furthermore, instead of a digital type printer, the present invention can be practiced in an analog type image forming apparatus using an analog type exposure device.

The present invention has been described with respect to the printers 100, 100A, and 100B as examples of image forming apparatuses. However, it is needless to say that the present invention can be applied to other image forming apparatuses such as a copying machine, a facsimile machine, etc.

Further, when the image forming apparatuses according to the above embodiments are color image forming apparatuses, the order of forming images of respective colors and/or the arrangement of the developing devices for respective colors are not limited to the ones described above and can be practiced otherwise.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-057898 filed in the Japanese Patent Office on Mar. 2, 2001, and Japanese Patent Application No. 2001-189785 filed in the Japanese Patent Office on Jun. 22, 2001, and Japanese Patent Application No. 2002-043140 filed in the Japanese Patent Office on Feb. 20, 2002, and the entire contents of each of which are hereby incorporated herein by reference.

What is claimed:

1. An image forming apparatus, comprising:

an image bearing member configured to bear visual images;

a visual image forming device configured to form the visual images on the image bearing member;

a two-side transfer device including a recording medium holding member spanning a plurality of stretch members to hold a recording medium thereon, the two-side transfer device configured to transfer respective of the visual images on the image bearing member onto respective of both sides of the recording medium on the recording medium holding member while the recording medium holding member is moved in a predetermined direction; and a fixing device configured to fix the visual images transferred onto the both sides of the recording medium, wherein the image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

2. The image forming apparatus according to claim 1, wherein the image bearing member intrudes into the part of the recording medium holding member spanning the two adjacent stretch members by an intrusion amount of about 0.6 mm or less.

3. The image forming apparatus according to claim 2, wherein the two adjacent stretch members are two adjacent rollers flexed by tension applied from the recording medium holding member to the two adjacent rollers by a flexibility amount of about 0.5 mm or less, respectively.

4. The image forming apparatus according to claim 3, wherein the two adjacent rollers are flexed by tension applied from the recording medium holding member to the rollers by a flexibility amount of about 0.1 mm or less, respectively.

5. The image forming apparatus according to claim 3, wherein one of the two adjacent rollers is provided downstream of a contact position of the image bearing member and the recording medium holding member in a moving direction of the recording medium holding member and is a conductive roller.

6. The image forming apparatus according to claim 5, wherein the conductive roller is a metallic roller.

7. The image forming apparatus according to claim 5, wherein one of the two adjacent rollers is provided upstream of the contact position of the image bearing member and the recording medium holding member in the moving direction of the recording medium holding member and is grounded.

8. The image forming apparatus according to claim 7, wherein the two adjacent rollers are separated from each other by a space of about 5 mm or greater.

9. The image forming apparatus according to claim 7, further comprising a sheet feeding device configured to feed the recording medium toward a contact part of the recording medium holding member and the image bearing member, wherein the sheet feeding device is arranged so that a leading edge of the recording medium fed from the sheet feeding device contacts the image bearing member before the recording medium holding member.

10. The image forming apparatus according to claim 3, wherein a conductive brush is provided between the two adjacent rollers to contact a rear surface of the recording medium holding member.

11. The image forming apparatus according to claim 7, wherein one of the two adjacent rollers is provided upstream of a contact position of the image bearing member and the recording medium holding member in a moving direction of the recording medium holding member and is grounded.

12. The image forming apparatus according to claim 11, wherein the two adjacent rollers are separated from each other by a space of about 5 mm or greater.

13. The image forming apparatus according to claim 11, further comprising a sheet feeding device configured to feed the recording medium toward a contact part of the recording medium holding member and the image bearing member, wherein the sheet feeding device is arranged so that a leading edge of the recording medium fed from the sheet feeding device contacts the image bearing member before the recording medium holding member.

14. The image forming apparatus according to claim 1, further comprising a contacting/separating device configured to contact and separate the recording medium holding member with and from the image bearing member.

15. The image forming apparatus according to claim 14, further comprising a control device configured to control an operation of the apparatus, wherein the control device controls the contacting/separating device so that the recording medium holding member is brought into contact with the image bearing member during at least a period of time in which the visual images on the image bearing member pass a position where the visual images oppose the recording medium holding member by rotation of the image bearing member.

16. The image forming apparatus according to claim 15, wherein the control device further controls the contacting/separating device so that the recording medium holding member is brought into contact with the image bearing member during a period of time in which the visual image forming device forms the visual images on the image bearing member.

17. The image forming apparatus according to claim 14, further comprising a control device configured to control an operation of the apparatus, and a detecting device configured to detect an occurrence of a recording medium jam in a recording medium conveying path, wherein the control device controls the contacting/separating device to separate the recording medium holding member from the image bearing member based on a detected output of the detecting device.

18. The image forming apparatus according to claim 1, wherein the image bearing member includes a first image bearing member configured to bear the visual images, and a second image bearing member configured to bear the visual images transferred from the first image bearing member, and wherein the image bearing member that intrudes into the part of the recording medium holding member spanning the two adjacent stretch members is the second image bearing member, and wherein the two-side transfer device is configured to transfer the respective visual images on the second image bearing member onto respective of both sides of the recording medium on the recording medium holding member.

19. The image forming apparatus according to claim 18, wherein the first image bearing member is a photoreceptor.

20. The image forming apparatus according to claim 18, further comprising an electrostatic latent image forming device configured to form an electrostatic latent image on the first image bearing member, and a plurality of developing devices configured to develop the electrostatic latent images on the first image bearing member to form respective visual images of different colors.

21. The image forming apparatus according to claim 18, wherein the image bearing member includes a plurality of first image bearing members configured to bear visual images of different colors, respectively.

22. The image forming apparatus according to claim 1, further comprising a receiving device configured to receive a control signal sent from a host computer, and a control device configured to control the image bearing member, the visual image forming device, the fixing device, and the two-side transfer device to drive according to the control signal received by the receiving device.

23. The image forming apparatus according to claim 1, wherein the two-side transfer device is detachably attached to a main body of the image forming apparatus.

24. A method of forming an image, comprising:

forming a visual image on an image bearing member;

transferring the visual image formed on the image bearing member onto a recording medium while bending the recording medium; and fixing the visual image on the recording medium, wherein the image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

25. The method according to claim 24, wherein the transferring the visual image includes transferring respective of visual images on the image bearing member onto respective of both sides of the recording medium.

26. A method of transferring a visual image formed on an image bearing member onto a recording medium, comprising:

feeding the recording medium to a transfer position; and transferring the visual image on the image bearing member onto the recording medium while bending the recording medium, wherein the image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

27. The method according to claim 26, wherein the transferring the visual image includes transferring respective of visual images on the image bearing member onto respective of both sides of the recording medium.

28. An image forming apparatus, comprising:

means for bearing visual images;

means for forming the visual images on the means for bearing;

means for transferring the visual images on the means for bearing onto both sides of a recording medium, the means for transferring including means for holding a recording medium spanning a plurality of stretch members, the means for transferring transfers respective of the visual images on the means for bearing onto respective of both sides of the recording medium on the means for holding while the means for holding is moved in a predetermined direction; and means for fixing the visual images transferred onto the both sides of the recording medium, wherein the means for bearing intrudes into a part of the means for holding spanning two adjacent stretch members of the plurality of stretch members by an intrusion amount of about 0.2 mm or greater so that the means for holding moves in contact with the means for bearing, having a contact width in a predetermined direction.

29. The image forming apparatus according to claim 28, further comprising means for contacting and separating the means for holding with and from the means for bearing.

30. The image forming apparatus according to claim 29, further comprising means for controlling an operation of the apparatus, wherein the means for controlling controls the means for contacting and separating so that the means for holding is brought into contact with the means for bearing during at least a period of time in which the visual image on the means for bearing passes a position where the visual images oppose the means for holding by rotation of the means for bearing.

31. The image forming apparatus according to claim 29, further comprising means for controlling an operation of the apparatus, and means for detecting an occurrence of a recording medium jam in a recording medium conveying path, wherein the means for controlling controls the means for contacting and separating to separate the means for holding from the means for bearing based on a detected output of the means for detecting.

32. The image forming apparatus according to claim 28, wherein the means for bearing includes first means for bearing the visual images, and second means for bearing the visual images transferred from the first means for bearing, and wherein the means for bearing that intrudes into the part of the means for holding spanning the two adjacent stretch members is the second means for bearing, and wherein the means for transferring transfers respective of the visual images on the second means for bearing onto respective of both sides of the recording medium on the means for holding.

33. The image forming apparatus according to claim 32, further comprising means for forming electrostatic latent images on the first means for bearing, and a plurality of means for developing the electrostatic latent images on the first means for bearing to form respective visual images of different colors.

34. The image forming apparatus according to claim 28, further comprising means for receiving a control signal sent from a host computer, and means for controlling the means for bearing, the means for forming, the means for fixing, and the means for transferring to drive according to the control signal received by the means for receiving.

35. An image forming method, comprising:

forming visual images on an image bearing member;

transferring respective of the visual images on the image bearing member onto respective of both sides of a recording medium on a recording medium holding member while the recording medium holding member is moved in a predetermined direction by utilizing a two-side transfer device, the recording medium holding member spanning a plurality of stretch members to hold the recording medium thereon; and fixing the visual images transferred onto the both sides of the recording medium, wherein in the transferring the image bearing member intrudes into a part of the recording medium holding member spanning two adjacent stretch members of the plurality of stretch members by an intrusion amount of about 0.2 mm or greater so that the recording medium holding member moves in contact with the image bearing member, having a contact width in a predetermined direction.

36. The image forming method according to claim 35, wherein in the transferring the image bearing member intrudes into the part of the recording medium holding member spanning the two adjacent stretch members by an intrusion amount of about 0.6 mm or less.

37. The image forming method according to claim 35, further comprising feeding the recording medium toward a contact part of the recording medium holding member and the image bearing member so that a leading edge of the recording medium fed from a sheet feeding device contacts the image bearing member before the recording medium holding member.

38. The image forming method according to claim 35, further comprising controlling an operation of the recording medium holding member so that the recording medium holding member is brought into contact with the image bearing member during at least a period of time in which the visual images on the image bearing member pass a position where the visual images oppose the recording medium holding member by rotation of the image bearing member.

39. The image forming method according to claim 38, further comprising controlling the operation so that the recording medium holding member is brought into contact with the image bearing member during a period of time in which the visual images are formed on the image bearing member.

40. The image forming method according to claim 35, further comprising controlling an operation of the recording medium holding member to detect an occurrence of a recording medium jam in a recording medium conveying path, and to separate the recording medium holding member from the image bearing member based on a detected output of a detecting device.

41. The image forming method according to claim 35, further comprising forming a plurality of electrostatic latent images on a first image bearing member to form respective visual images of different colors.

* * * * *